US011200830B2

(12) United States Patent
Sun et al.

(10) Patent No.: US 11,200,830 B2
(45) Date of Patent: Dec. 14, 2021

(54) METHOD AND APPARATUS FOR DRIVING DISPLAY PANEL, AND DISPLAY DEVICE

(71) Applicant: BOE Technology Group Co., Ltd., Beijing (CN)

(72) Inventors: Gaoming Sun, Beijing (CN); Hsinchung Lo, Beijing (CN); Xiaomang Zhang, Beijing (CN); Ching wen Kong, Beijing (CN); Yuxin Bi, Beijing (CN); Yang Gao, Beijing (CN); Zhenkun Song, Beijing (CN); Fuyin Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/838,117

(22) Filed: Apr. 2, 2020

(65) Prior Publication Data

US 2021/0097926 A1 Apr. 1, 2021

(30) Foreign Application Priority Data

Sep. 30, 2019 (CN) ..... 201910939673.6

(51) Int. Cl.
*G09G 5/10* (2006.01)
*G09G 3/20* (2006.01)

(52) U.S. Cl.
CPC ... *G09G 3/2074* (2013.01); *G09G 2310/0202* (2013.01); *G09G 2320/029* (2013.01)

(58) Field of Classification Search
CPC .. G09G 3/2074; G09G 3/3611; G09G 3/3614; G09G 3/3607; G09G 2310/0202; G09G 2310/065; G09G 2320/029; G09G 2320/0204; G09G 5/10
USPC ..... 345/204, 694
See application file for complete search history.

(56) References Cited

U.S. PATENT DOCUMENTS

2005/0168425 A1* 8/2005 Takada ..... G09G 3/3614 345/94
2006/0202927 A1* 9/2006 Lee ..... G09G 3/3648 345/88
2007/0229433 A1* 10/2007 Jang ..... G09G 3/3696 345/96

* cited by examiner

*Primary Examiner* — Jennifer T Nguyen
(74) *Attorney, Agent, or Firm* — Fay Sharpe LLP

(57) ABSTRACT

The present disclosure provides a method and apparatus for driving a display panel, and a display device. The method includes: upon driving an $i^{th}$ row of sub-pixels, scanning a gate line connected to a $j^{th}$ row of sub-pixels, and determining a reference grayscale of each of the $j^{th}$ row of sub-pixels in each candidate connection mode, wherein a plurality of data lines have a plurality of candidate connection modes; determining a target connection mode that minimizes a grayscale variation degree of the $j^{th}$ row of sub-pixels from the plurality of candidate connection modes; connecting the plurality of data lines according to the target connection mode; and disconnecting the plurality of data lines before driving the $j^{th}$ row of sub-pixels through the plurality of data lines.

17 Claims, 8 Drawing Sheets

METHOD AND APPARATUS FOR DRIVING DISPLAY PANEL, AND DISPLAY DEVICE

The present disclosure claims priority to Chinese Patent Application No. 201910939673.6, filed on Sep. 30, 2019 and entitled "METHOD AND APPARATUS FOR DRIVING DISPLAY PANEL, AND DISPLAY DEVICE", the entire contents of which are incorporated herein by reference.

TECHNICAL FIELD

Embodiments of the present disclosure relate to a method and apparatus for driving a display panel, and a display device.

BACKGROUND

With the development of display technologies, display devices with low power consumption are highly favored.

A display panel in a display device includes a plurality of sub-pixels arranged in an array, a plurality of gate lines arranged transversely, and a plurality of data lines arranged longitudinally. Each gate line is connected to a row of sub-pixels, and each data line is connected to a column of sub-pixels.

SUMMARY

Embodiments of the present disclosure provide a method and apparatus for driving a display panel, and a display device. The technical solutions are as follows:

In one aspect, a method for driving a display panel is provided. The method includes:

scanning a gate line connected to an $i^{th}$ row of sub-pixels, and driving the $i^{th}$ row of sub-pixels through a plurality of data lines of the display panel, where $i \geq 1$;

scanning a gate line connected to a $j^{th}$ row of sub-pixels, and determining a reference grayscale of each of the $j^{th}$ row of sub-pixels in each candidate connection mode, wherein the plurality of data lines have a plurality of candidate connection modes, and the $i^{th}$ row of sub-pixels and the $j^{th}$ row of sub-pixels are two rows of sub-pixels which are sequentially driven in the display panel, where $j \geq 1$;

determining a target connection mode that minimizes a grayscale variation degree of the $j^{th}$ row of sub-pixels from the plurality of candidate connection modes, wherein the grayscale variation degree is intended to characterize a total variation degree of the reference grayscale of each of the $j^{th}$ row of sub-pixels relative to a grayscale to be displayed;

connecting the plurality of data lines according to the target connection mode;

disconnecting the plurality of data lines; and driving the $j^{th}$ row of sub-pixels through the plurality of data lines.

Optionally, the plurality of data lines include a plurality of data line groups arranged in sequence, wherein each data line group includes at least two data lines; and in each candidate connection mods, any two connected data lines belong to the same data line group.

Optionally, before determining the target connection mode that minimizes the grayscale variation degree of the $j^{th}$ row of sub-pixels, the method further includes:

determining a sum of total variation amounts corresponding to the plurality of data line groups in each candidate connection mode as the grayscale variation degree of the $j^{th}$ row of sub-pixels in each candidate connection mode; wherein the total variation amount corresponding to each data line group is an absolute value of a sum of grayscale variation amounts of the respective sub-pixels connected to the data line group; and the grayscale variation amount of each sub-pixel is intended to characterize a variation amount of the reference grayscale of the sub-pixel relative to the grayscale to be displayed.

Optionally, upon determining the reference grayscale of each of the $j^{th}$ row of sub-pixels in each candidate connection mode, the method further includes:

determining a difference value between the reference grayscale of each sub-pixel in each candidate connection mode and the grayscale to be displayed;

determining that the grayscale variation amount of each sub-pixel in each candidate connection mode is zero if each sub-pixel satisfies a first condition; and determining the grayscale variation amount of each sub-pixel in each candidate connection mode as the difference value if each sub-pixel does not satisfy the first condition; wherein the first condition includes that the data line connected to each sub-pixel in each candidate connection mode is not connected to another data line, and an absolute value of the difference value is less than or equal to a grayscale threshold.

Optionally, scanning the gate line connected to the $i^{th}$ row of sub-pixels and driving the $i^{th}$ row of sub-pixels through a plurality of data lines in the display panel includes:

scanning the gate line connected to the $i^{th}$ row of sub-pixels according to a test image, and driving the $i^{th}$ row of sub-pixels through the plurality of data lines;

scanning the gate line connected to the $j^{th}$ row of sub-pixels includes:

scanning the gate line connected to the $j^{th}$ row of sub-pixels according to the test image;

connecting the plurality of data lines according to the target connection mode includes:

scanning the gate line connected to the $i^{th}$ row of sub-pixels according to a target image, driving the $i^{th}$ row of sub-pixels through the plurality of data lines, and then connecting the plurality of data lines according to the target connection mode, wherein the target image is different from the test image; and driving the $j^{th}$ row of sub-pixels through the plurality of data lines includes:

scanning the gate line connected to the $j^{th}$ row of sub-pixels according to the target image, and driving the $j^{th}$ row of sub-pixels through the plurality of data lines.

Optionally, the target image is a next frame image of the test image.

Optionally, in each candidate connection mode, the data lines in each data line group are connected in the same fashion.

Optionally, each data line group includes a plurality of first data lines and a plurality of second data lines, wherein the first data lines are configured to load a potential of a positive polarity, and the second data lines are configured to load a potential of a negative polarity.

Optionally, in each candidate connection mode, each data line group satisfies at least one of the following conditions: at least two first data lines in the data line group are connected; and at least two second data lines in the data line group are connected.

Optionally, each data line group includes three first data lines and three second data lines.

Optionally, each data line group is connected to sub-pixels in a pixel adjacent thereto, and the pixel includes a plurality of sub-pixels.

Optionally, the $j^{th}$ row of sub-pixels are the first row of sub-pixels which are driven after the $i^{th}$ row of sub-pixels are driven; in each candidate connection mode, the data lines in the respective data line groups are connected in the same fashion, and each data line group is connected to sub-pixels in a pixel adjacent thereto; the pixel includes a plurality of sub-pixels;

each data line group includes three first data lines and three second data lines, the first data lines being configured to load a potential of a positive polarity, and the second data lines being configured to load a potential of a negative polarity; in each candidate connection mode, each data line group satisfies at least one of the following conditions: at least two first data lines in the data line group are connected; and at least two second data lines in the data line group are connected;

scanning the gate line connected to the $i^{th}$ row of sub-pixels and driving the $i^{th}$ row of sub-pixels through the plurality of data lines includes:

scanning the gate line connected to the $i^{th}$ row of sub-pixels according to a test image, and driving the $i^{th}$ row of sub-pixels through the plurality of data lines;

scanning the gate line connected to the $j^{th}$ row of sub-pixels includes:

scanning the gate line connected to the $j^{th}$ row of sub-pixels according to the test image;

connecting the plurality of data lines according to the target connection mode includes:

scanning the gate line connected to the $i^{th}$ row of sub-pixels according to a target image, driving the $i^{th}$ row of sub-pixels through the plurality of data lines, and then connecting the plurality of data lines according to the target connection mode, wherein the target image is different from the test image; and driving the $j^{th}$ row of sub-pixels through the plurality of data lines includes:

scanning the gate line connected to the $j^{th}$ row of sub-pixels according to the target image, and driving the $j^{th}$ row of sub-pixels through the plurality of data lines.

In another aspect, an apparatus for driving a display panel is provided. The apparatus includes:

a first driving module, configured to scan a gate line connected to an $i^{th}$ row of sub-pixels, and drive the $i^{th}$ row of sub-pixels through a plurality of data lines of the display panel, where $i \geq 1$;

a first determining module, configured to scan a gate line connected to a $j^{th}$ row of sub-pixels, and determine a reference grayscale of each sub-pixel in the $j^{th}$ row of sub-pixels in each candidate connection mode, wherein the display panel includes the plurality of data lines, the plurality of data lines have a plurality of candidate connection modes, and the $i^{th}$ row of sub-pixels and the $j^{th}$ row of sub-pixels are two rows of sub-pixels sequentially driven in the display panel, where $j \geq 1$;

a second determining module, configured to determine a target connection mode that minimizes a grayscale variation degree of the $j^{th}$ row of sub-pixels from the plurality of candidate connection modes; wherein the grayscale variation degree is intended to characterize a total variation degree of the reference grayscale of each sub-pixel in the $j^{th}$ row of sub-pixels relative to a grayscale to be displayed;

a connecting module, configured to connect the plurality of data lines according to the target connection mode;

a disconnecting module, configured to disconnect the plurality of data lines; and a second driving module, configured to drive the $j^{th}$ row of sub-pixels through the plurality of data lines.

Optionally, the plurality of data lines include a plurality of data line groups which are arranged in sequence, wherein each data line group includes at least two data lines; and in each candidate connection mode, any two connected data lines belong to the same data line group.

Optionally, the apparatus further includes:

a third determining module, configured to determine a sum of total variation amounts corresponding to the plurality of data line groups in each candidate connection mode as the grayscale variation degree of the $j^{th}$ row of sub-pixels in each candidate connection mode, wherein the total variation amount corresponding to each data line group is an absolute value of a sum of grayscale variation amounts of the respective sub-pixels connected to the data line group; and the grayscale variation amount of each sub-pixel is intended to characterize a variation amount of the reference grayscale of the sub-pixel relative to the grayscale to be displayed.

Optionally, the apparatus further includes:

a fourth determining module, configured to determine a difference value between the reference grayscale of each sub-pixel in each candidate connection mode and the grayscale to be displayed;

a fifth determining module, configured to determine that the grayscale variation amount of each sub-pixel in each candidate connection mode is zero when each sub-pixel satisfies a first condition; and a sixth determining module, configured to determine the grayscale variation amount of each sub-pixel in each candidate connection mode as the difference value when each sub-pixel does not satisfy the first condition; wherein the first condition includes that the data line connected to each sub-pixel is not connected to another data line in each candidate connection mode, and an absolute value of the difference value is less than or equal to a grayscale threshold.

Optionally, each row of sub-pixels constitutes a plurality of pixels sequentially arranged in the arrangement direction, and each pixel includes a plurality of sub-pixels; the sub-pixels connected to each data line group belong to two adjacent pixels in the plurality of pixels.

Optionally, the first driving module is configured to:

scan a gate line connected to the $i^{th}$ row of sub-pixels according to a test image, and drive the $i^{th}$ row of sub-pixels through the plurality of data lines;

the first determining module is configured to scan the gate line connected to the $j^{th}$ row of sub-pixels according to the test image;

the connecting module is configured to scan the gate line connected to the $i^{th}$ row of sub-pixels according to a target image, drive the $i^{th}$ row of sub-pixels through the plurality of data lines, and then connect the plurality of data lines according to the target connection mode, wherein the target image is different from the test image; and the second driving module is configured to scan a gate line connected to the $j^{th}$ row of sub-pixels according to the target image, and drive the $j^{th}$ row of sub-pixels through the plurality of data lines.

Optionally, the target image is a next frame image of the test image.

Optionally, the $j^{th}$ row of sub-pixels is the first row of sub-pixels which are driven after the $i^{th}$ row of sub-pixels are driven.

Optionally, in each candidate connection mode, the data lines in each data line group are connected in the same fashion.

Optionally, each data line group includes a plurality of first data lines and a plurality of second data lines, wherein the first data lines are configured to load a potential of a positive polarity, and the second data are being configured to load a potential of a negative polarity; and in each candidate connection mode, each data line group satisfies at least one of the following conditions:

at least two first data lines in the data line group are connected; and at least two second data lines in the data line group are connected.

Optionally, each data line group includes three first data lines and three second data lines.

Optionally, each data line group is connected to sub-pixels in a pixel adjacent thereto, and the pixel includes a plurality of sub-pixels.

Optionally, the $j^{th}$ row of sub-pixels are the first row of sub-pixels which are driven after the $i^{th}$ row of sub-pixels are driven; in each candidate connection mode, the data lines in each data line group are connected in the same fashion, and the data line group is connected to sub-pixels in a pixel adjacent thereto; the pixel includes a plurality of sub-pixels;

each data line group includes three first data lines and three second data lines, the first data lines being configured to load a potential of a positive polarity, and the second data lines being configured to load a potential of a negative polarity; in each candidate connection mode, each data line group satisfies at least one of the following conditions: at least two first data lines in the data line group are connected; and at least two second data lines in the data line group are connected.

Optionally, the first driving module is configured to:

scan a gate line connected to the $i^{th}$ row of sub-pixels according to a test image, and drive the $i^{th}$ row of sub-pixels through the plurality of data lines;

the first determining module is configured to scan a gate line connected to the $j^{th}$ row of sub-pixels according to the test image;

the connecting module is configured to: scan the gate line connected to the $i^{th}$ row of sub-pixels according to a target image, drive the $i^{th}$ row of sub-pixels through the plurality of data lines, and then connect the plurality of data lines according to the target connection mode, wherein the target image is different from the test image; and the second driving module is configured to scan the gate line connected to the $j^{th}$ row of sub-pixels according to the target image, and drive the $j^{th}$ row of sub-pixels through the plurality of data lines.

In yet another aspect, an apparatus for driving a display panel is provided. The apparatus is configured to perform the method for driving the display panel.

In still another aspect, a display device is provided. The display device includes a display panel and the apparatus for driving the display panel.

In still another aspect, an apparatus for use in driving a display panel is provided. The apparatus includes a processor and a memory, wherein the processor is configured to execute a program stored in the memory to implement the method for driving the display panel.

In still another aspect, a computer-readable storage medium is provided. The computer-readable storage memory is configured to store a computer program therein, which, when being performed by a processor, enables the processor to perform the method for driving the display panel.

In still another aspect, a computer program product is provided, which, when running on a computer, causes the computer to perform the driving method for the display panel.

DETAILED DESCRIPTION

For clearer descriptions of the principles, technical solutions and advantages in the present disclosure, the present disclosure is described in detail below in combination with the specific embodiments and the accompanying drawings.

With the development of a display technology, display devices of low power consumption are highly favored. The display device includes a display panel, and a driving apparatus configured to drive the display panel to display an image. In case of driving the display panel to display the image, the driving device may sequentially drive a plurality of rows of sub-pixels. Prior to driving a row of the sub-pixels, the apparatus may scan a gate line connected to each row of sub-pixels. In the case of driving a row of sub-pixels, the display device may provide a data line with a potential corresponding to the current row of sub-pixels to charge the row of sub-pixels, such that each sub-pixel in the row of sub-pixels emits light of a desired brightness. Since the potential of the data line generally varies greatly when driving sub-pixels in adjacent rows, the amount of power required to charge the sub-pixels is relatively large, and the power consumption required for the apparatus to drive the display panel to display an image is relatively large.

An embodiment of the present disclosure provides a method for driving a display panel. When an apparatus for driving a display panel drives the display panel to display an image through the method, the total charging amount of each sub-pixel in the display panel is reduced, thereby reducing the power consumption required for the apparatus to drive the display panel to display the image.

Figure 1:
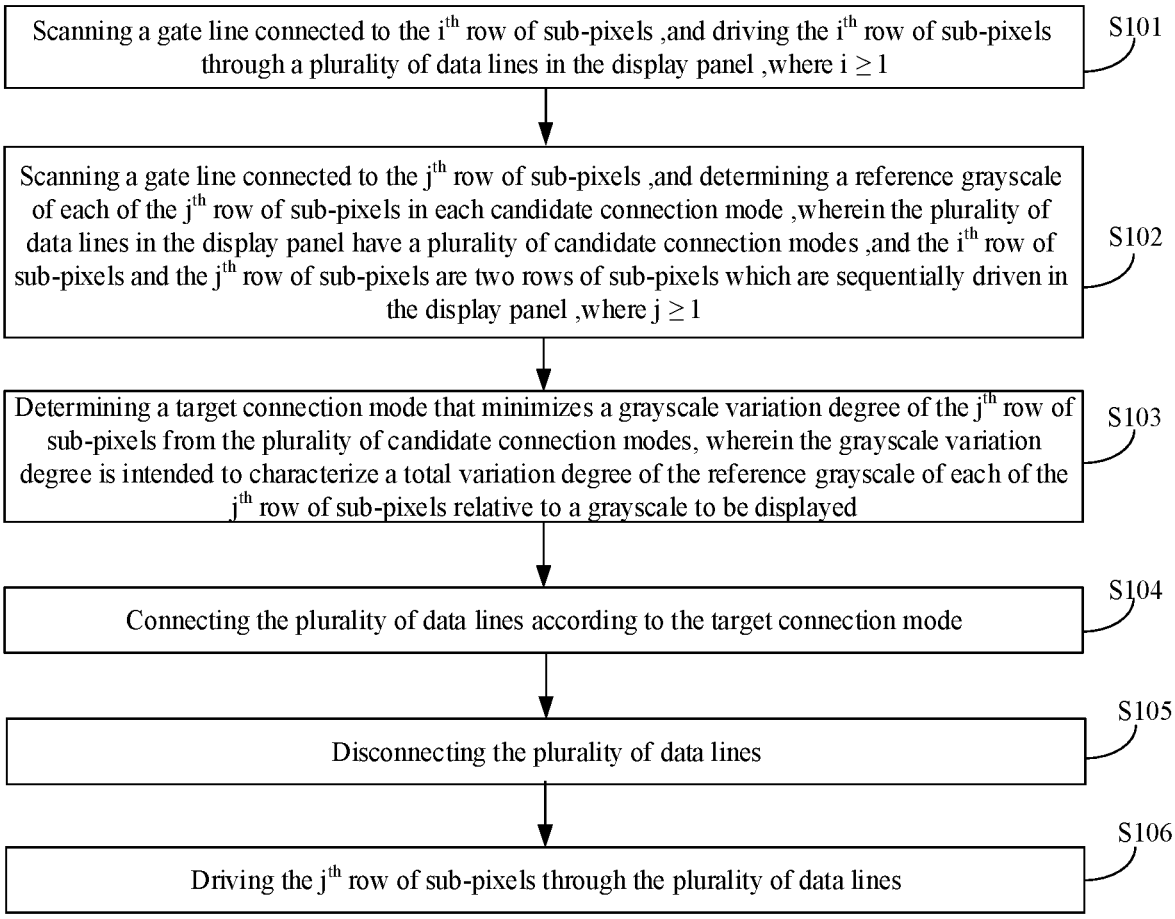
FIG. 1 is a flowchart of a method for driving a display panel according to an embodiment of the present disclosure.

Exemplarily, FIG. 1 is a flowchart of a method for driving a display panel according to an embodiment of the present disclosure. The method is implemented by a driving apparatus. As shown in FIG. 1, the method may include the following steps.

In S101, a gate line connected to an $i^{th}$ row of sub-pixels is scanned, and the $i^{th}$ row of sub-pixels are driven through a plurality of data lines of the display panel, where $i \geq 1$.

In S102, a gate line connected to a $j^{th}$ row of sub-pixels is scanned, and a reference grayscale of each of the $j^{th}$ row in each candidate connection mode is determined, wherein the plurality of data lines in the display panel have a plurality of candidate connection modes, and the $i^{th}$ row of sub-pixels and the $j^{th}$ row of sub-pixels are two rows of sub-pixels which are sequentially driven in the display panel, where $j \geq 1$.

In S103, a target connection mode that minimizes a grayscale variation degree of the $j^{th}$ row of sub-pixels is determined from the plurality of candidate connection modes, wherein the grayscale variation degree is intended to characterize a total variation degree of the reference grayscale of each sub-pixel in the $j^{th}$ row of sub-pixels relative to a grayscale to be displayed.

In S104, the plurality of data lines are connected according to the target connection mode.

In S105, the plurality of data lines are disconnected.

In S106, the $j^{th}$ row of sub-pixels are driven through the plurality of data lines.

As can be seen from the above driving method, the $i^{th}$ row of sub-pixels and the $j^{th}$ row of sub-pixels are two rows of sub-pixels which are sequentially driven in the display panel. For example, if the $i^{th}$ row of sub-pixels is not the last row of sub-pixels in the display panel, the $j^{th}$ row of sub-pixels is an $(i+1)^{th}$ row of sub-pixels; and if the $i^{th}$ row of sub-pixels is the last row of sub-pixels in the display panel, the $j^{th}$ row of sub-pixels is the first row of sub-pixels.

In summary, in the method for driving the display panel according to the embodiment of the present disclosure, the plurality of data lines in the display panel may be connected according to the target connection mode before the $j^{th}$ row of sub-pixels are driven. Since the potentials of the interconnected data lines in the plurality of data lines are the same, the potential on the interconnected data lines may vary in advance before the $j^{th}$ row of sub-pixels are driven, thereby achieving an effect of pre-charging the $j^{th}$ row of sub-pixels. In the process of driving the $j^{th}$ row of sub-pixels, the potential on the plurality of data lines varies slightly. Therefore, the power consumption required for the apparatus to drive the $j^{th}$ row of sub-pixels is reduced.

Further, the target connection mode is a candidate connection mode that minimizes the grayscale variation degree of the $j^{th}$ row of sub-pixels in the plurality of candidate connection modes. When a plurality of data lines are connected according to this target connection mode, the $j^{th}$ row of sub-pixels are pre-charged to the greatest extent, thereby minimizing the power consumption required to drive the $j^{th}$ row of sub-pixels.

In addition, in the embodiment of the present disclosure, the target connection mode corresponding to each row of sub-pixels may be determined according to a grayscale to be displayed of the row of sub-pixels. Therefore, the connection mode of the data lines may be flexibly adjusted for each row of sub-pixels in the display panel, such that the display panel is driven more flexibly to display the image. For each row of sub-pixels, the data lines are connected according to the target connection mode that minimizes the grayscale variation degree of the sub-pixels. Therefore, the overall power consumption required for the apparatus to drive the display panel to display the image is relatively low.

The display panel may include a plurality of sub-pixels arranged in an array, a plurality of gate lines, and a plurality of data lines. Each gate line is connected to a row of sub-pixels, and different gate lines are connected to different rows of sub-pixels. Each data line is connected to a column of sub-pixels, and different data lines are connected to different columns of sub-pixels. The plurality of data lines in the display panel include a plurality of first data lines and a plurality of second data lines. The first data lines are configured to load a potential of a positive polarity, and the second data lines are configured to load a potential of a negative polarity. The polarity of a potential on the sub-pixels connected to the first data line is positive, and the polarity of a potential on the sub-pixels connected to the second data line is negative.

The polarity of each data line in the display panel is determined by three polarity control signals applied to the display panel. These three polarity control signals may be expressed as POL, POLC and POL2 in Table 1, respectively. Please refer to Table 1 below, which shows the polarities of the plurality of data lines in the display panel determined by different combinations of these three polarity control signals. In Table 1, $n \geq 0$; "H" means that the potential of the polarity control signal is high; "L" means that the potential of the polarity control signal is low; "−" means that the data lines are configured to load a negative polarity potential; and "+" means that the data lines are configured to load a potential of a positive polarity.

TABLE 1

| Polarity control signals | | | Data lines | | | | Arrangement mode |
|---|---|---|---|---|---|---|---|
| POL | POLC | POL2 | $(4n+1)^{th}$ | $(4n+2)^{th}$ | $(4n+3)^{th}$ | $(4n+4)^{th}$ | of data lines |
| H | H | H | − | + | − | + | First arrangement mode |
| | H | L | − | + | + | − | Second arrangement mode |
| | L | H | + | − | − | + | Third arrangement mode |
| | L | L | + | − | + | − | Fourth arrangement mode |
| L | H | H | + | − | + | − | Fourth arrangement mode |
| | H | L | + | − | − | + | Third arrangement |

TABLE 1-continued

| Polarity control signals | | | Data lines | | | | Arrangement mode |
|---|---|---|---|---|---|---|---|
| POL | POLC | POL2 | $(4n+1)^{th}$ | $(4n+2)^{th}$ | $(4n+3)^{th}$ | $(4n+4)^{th}$ | of data lines |
| | | | | | | | mode |
| | L | H | − | + | + | − | Second arrangement mode |
| | L | L | − | + | − | + | First arrangement mode |

As can be seen from Table 1, the four arrangement modes (e.g., the first, second, third and fourth arrangement modes in Table 1) of the first data lines and the second data lines may be determined through the polarity control signals in the display panel. The four arrangement modes may be divided into two types. In the first type of arrangement mode, the first data lines and the second data lines are alternately arranged, that is, any two adjacent data lines are configured to load potentials of different polarities (e.g., the first and fourth arrangement modes in Table 1). In the second type of arrangement mode, the potential loaded by any data line has the same polarity as the potential loaded by the data line adjacent thereto at one side, and has a different polarity from the potential loaded by the data line adjacent thereto at the other side (e.g., the second and third arrangement modes in Table 1). It should be noted that, for a completed display panel, the polarity control signals in the display panel are fixed. Therefore, =one arrangement mode is available for the first data lines and the second data lines in the display panel.

The plurality of data lines in the display panel may include a plurality of data line groups sequentially arranged in an arrangement direction of the plurality of data lines, the number of data lines in each data line group is greater than 1. The plurality of data lines in the display panel may have a plurality of candidate connection modes. In addition, in each candidate connection mode, any two connected data lines belong to the same data line group. The following embodiments of the present disclosure will be explained by taking the case that the number of data lines in each data line group is 6, and in the plurality of candidate connection modes, the data lines in each data line group have a plurality of connection modes as an example. Optionally, in the plurality of candidate connection modes, a data line group having only one connection mode may also be present in the plurality of data line groups.

Optionally, in the embodiment of the present disclosure, each of the plurality of data line groups may include three first data lines and three second data lines. The three first data lines may have four connection modes, which may include: one connection mode in which three first data lines are connected, and three connection modes in which any two first data lines are connected. The three second data lines may have four connection modes, which may include one connection mode in which three second data lines are connected, and three connection modes in which any two second data lines are connected.

Figure 2:
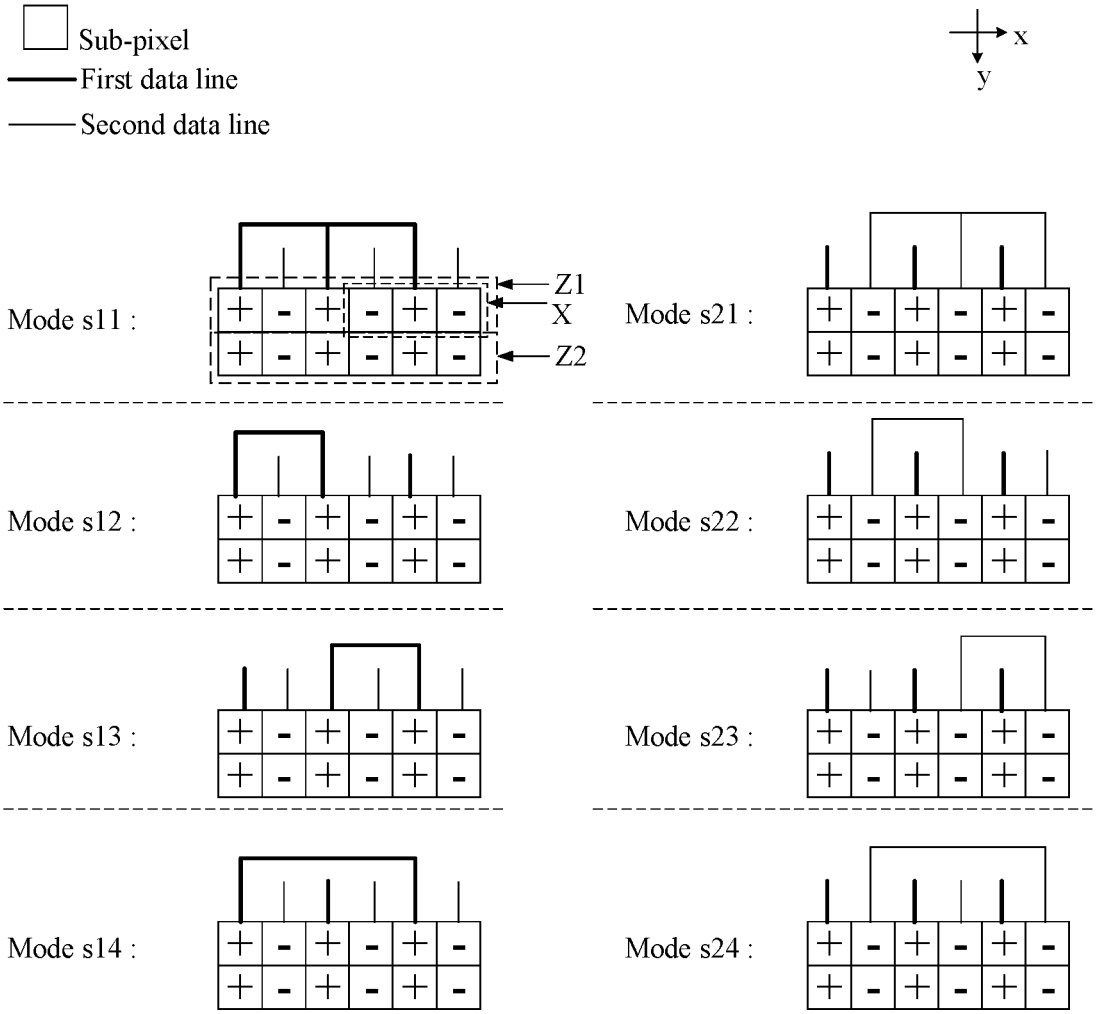
FIG. 2 is a schematic diagram of connection modes of data lines in a data line group according to an embodiment of the present disclosure.
Figure 3:
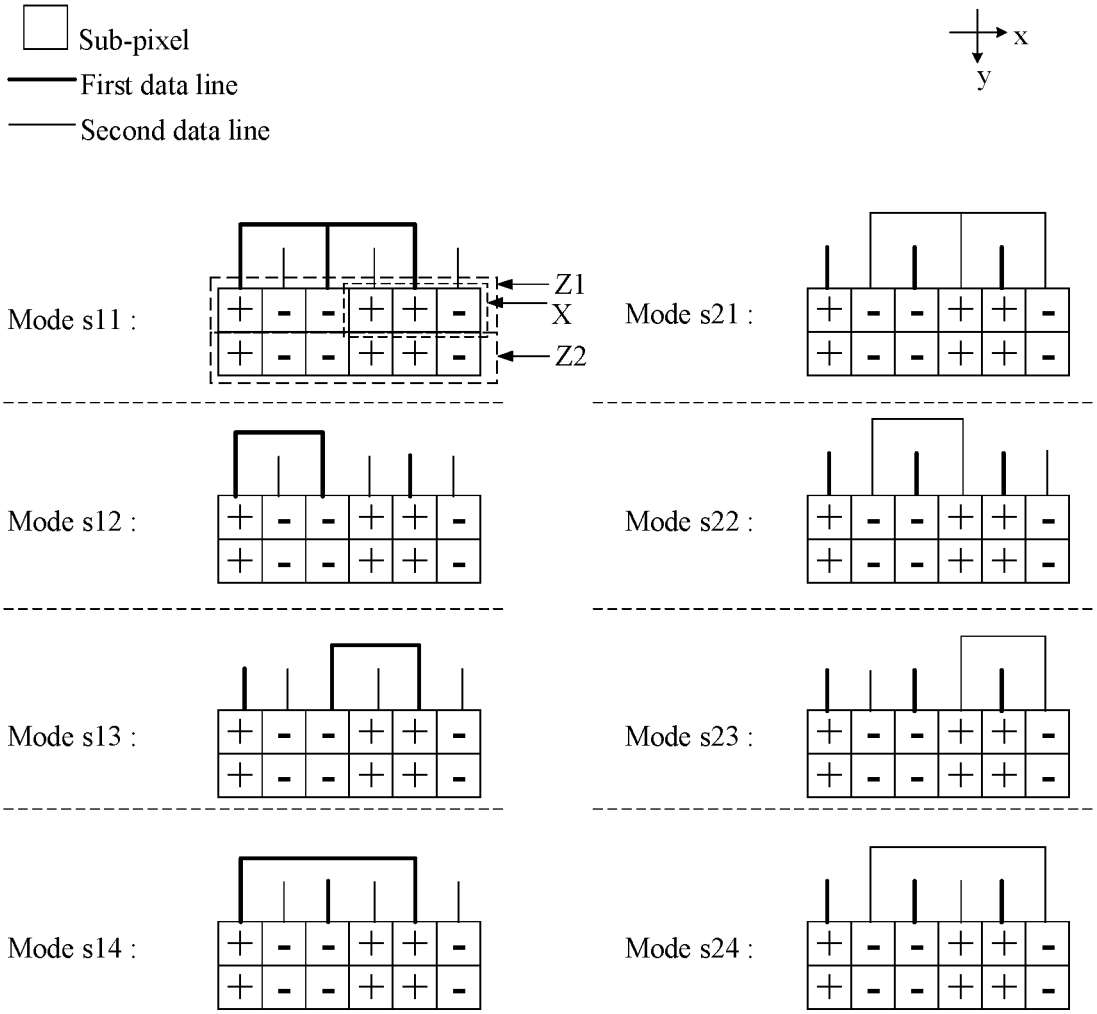
FIG. 3 is a schematic diagram of connection modes of data lines in another data line group according to an embodiment of the present disclosure.

Exemplarily, FIG. 2 is a schematic diagram of connection modes of data lines in one data line group according to an embodiment of the present disclosure. FIG. 3 is a schematic diagram of connection modes of data lines in another data line group according to an embodiment of the present disclosure. In addition, FIG. 2 takes the first data lines and the second data lines being arranged according to the first type of arrangement mode as an example. FIG. 3 takes the first data lines and the second data lines being arranged according to the second type of arrangement mode as an example. In FIG. 2 and FIG. 3, the polarity of a potential on a sub-pixel labeled "+" is positive, and the sub-pixel is connected to the first data lines; and the polarity of a potential on a sub-pixel labeled "−" is negative, and the sub-pixel is connected to the second data lines. As shown in FIG. 2 and FIG. 3, the four connection modes of three first data lines in the data line group may include Mode s11, Mode s12, Mode s13, and Mode s14. The Mode s11 is a mode in which these three first data lines are all connected, and the Modes s12, s13, and s14 are three connection modes in which two first data lines in three first data lines are connected. The four connection modes of three second data lines in the data line group may include Mode s21, Mode s22, Mode s23, and Mode s24. The Mode s21 is a mode in which these three second data lines are all connected, and the Modes s22, s23, and s24 are three connection modes in which two second data lines in three second data lines are connected. It should be noted that, in each row of sub-pixels, the sub-pixels connected to each data line group may be referred to as a sub-pixel group. FIG. 2 and FIG. 3 show only two sub-pixel groups Z1 and Z2 of two rows of sub-pixels, and the two sub-pixel groups are arranged in an extension direction y of the data lines.

Optionally, in each connection mode of the data lines in the data line group, it is possible that the first data lines are connected and the second data lines are also connected, such that the data lines in each data line group can have 16 connection modes. In this case, in each candidate connection mode, at least two first data lines in the data line group are connected; and at least two second data lines in the data line group are connected.

Optionally, in each connection mode of the data lines in the data line group, it is possible that only the first data lines are connected (or only the second data lines are connected) in each data line group, such that the data lines in each data line group can have 4 connection modes. In this case, in each candidate connection mode, at least two first data lines in the data line group are connected (or at least two second data lines in the data line group are connected).

Optionally, in the embodiment of the present disclosure, each row of sub-pixels in the display panel constitute a plurality of pixels which are sequentially arranged, and each pixel includes a plurality of sub-pixels. The sub-pixels connected to each data line group belong to two adjacent pixels in the plurality of pixels. Exemplarily, please continuing to FIG. 2 and FIG. 3, which show six sub-pixels in each row of sub-pixels. In addition, these six sub-pixels constitute two pixels X which are sequentially arranged in an arrangement direction x of the data lines, and each pixel X includes three sub-pixels. Optionally, the colors of the three sub-pixels may be different. Optionally, each pixel may include only two sub-pixels, four sub-pixels, or even more sub-pixels. At least two sub-pixels with the same color are present in each pixel, which is not limited in the embodiment of the present disclosure. When each pixel includes two sub-pixels, each data line group may include four data lines. When each pixel includes four sub-pixels, each data line group may include eight data lines.

In the embodiment of the present disclosure, the sub-pixels connected to each data line group belong to two adjacent pixels in the plurality of pixels. In this way, possible connection modes for the data lines in each data line group are fewer, and the candidate connection modes for a plurality of data lines are fewer. Therefore, the process of determining the target connection mode in the plurality of candidate connection modes is relatively simple to improve the efficiency of determining the target connection mode.

Optionally, in the embodiment of the present disclosure, when the plurality of data lines are connected according to each candidate connection mode, the connection modes of the data lines in each data line group are the same. In this case, the number of the candidate connection modes of the plurality of data lines is the same as the number of connection modes of the data lines in each data line group. Optionally, when the plurality of data lines in the display panel is connected according to each candidate connection mode, the connection modes of the data lines in each data line group may also be different, which is not limited in the embodiment of the present disclosure.

Figure 4:
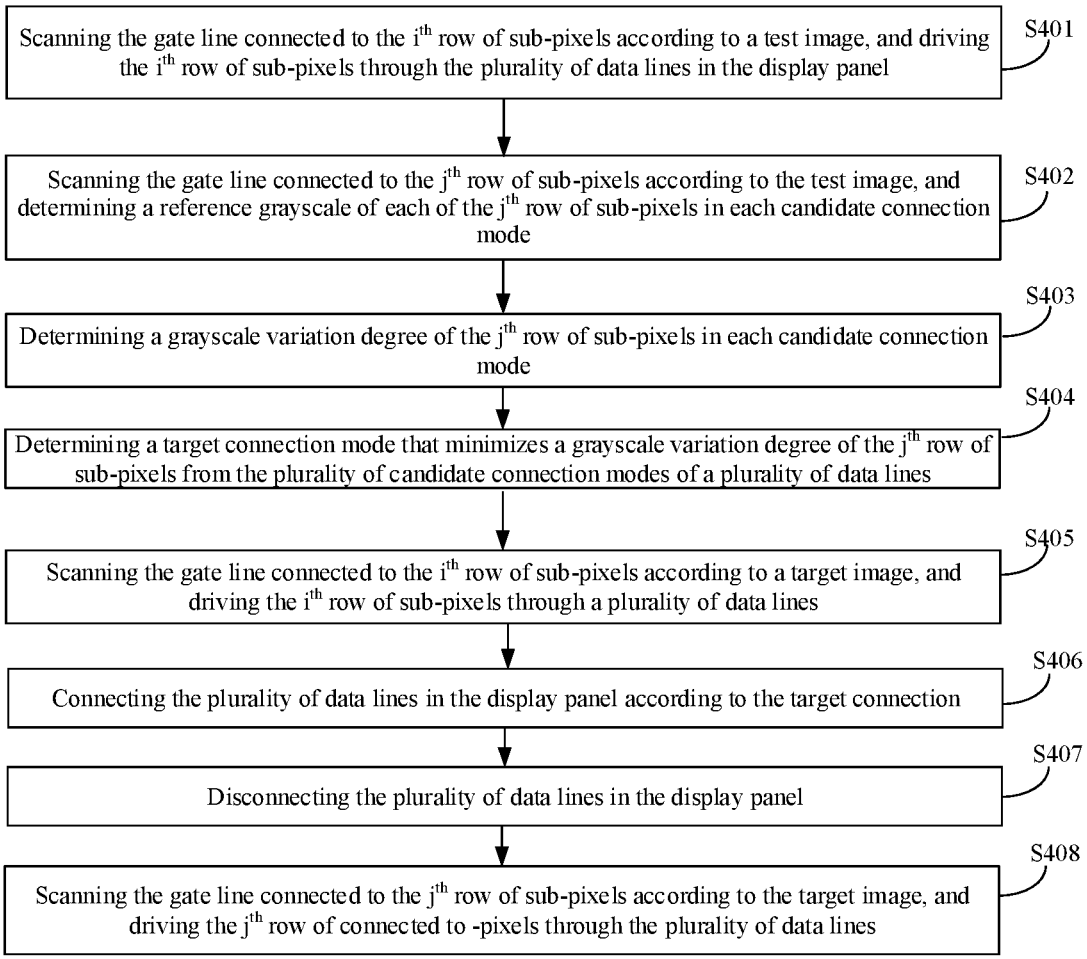
FIG. 4 is a flowchart of another method for driving a display panel according to an embodiment of the present disclosure.

FIG. 4 is a flowchart of another method for driving a display panel according to an embodiment of the present disclosure. The driving method may be performed by an apparatus for driving the display panel. As shown in FIG. 4, the method may include the following steps.

In S401, a gate line connected to an $i^{th}$ row of sub-pixels is scanned according to a test image, and the $i^{th}$ row of sub-pixels are driven through a plurality of data lines of the display panel, where $i \geq 1$.

It should be noted that when the gate line connected to each row of sub-pixels is scanned, channels between the row of sub-pixels and the plurality of data lines are turned on. In this case, the potentials on the plurality of data lines may be transmitted to the row of sub-pixels, but not to sub-pixels in other rows. Therefore, after the gate line connected to the $i^{th}$ row of sub-pixels is scanned, the potentials on the plurality of data lines may be transmitted to the $i^{th}$ row of sub-pixels.

In S402, a gate line connected to a $j^{th}$ row of sub-pixels is scanned according to the test image, and a reference grayscale of each sub-pixel in the $j^{th}$ row of the sub-pixels in each candidate connection mode is determined.

The plurality of data lines in the display panel have a plurality of candidate connection modes, and the $i^{th}$ row of sub-pixels and the $j^{th}$ row of sub-pixels are two rows of sub-pixels which are sequentially driven in the display panel, where $j \geq 1$.

For the explanation of the $i^{th}$ row of sub-pixels and the $j^{th}$ row of sub-pixels, please refer to related explanations in the embodiment shown in FIG. 1, which is not described in the embodiment of the present disclosure.

The reference grayscale of each sub-pixel in the $j^{th}$ row in each candidate connection mode of the plurality of data lines is a grayscale of each sub-pixel in the $j^{th}$ row of sub-pixels if the plurality of data lines are connected according to the candidate connection mode, after the $i^{th}$ row of sub-pixels are driven according to the test image and the gate line connected to the $j^{th}$ row of sub-pixels is scanned.

It should be noted that when the apparatus drives a sub-pixel in the display panel, the magnitude of the grayscale of the sub-pixel can be adjusted by adjusting the magnitude of a potential loaded on the data line connected to the sub-pixel. When the apparatus drives a row of sub-pixels in the display panel, a potential loaded on the data line connected to each sub-pixel in this row of sub-pixels matches a grayscale to be displayed of this sub-pixel, such that this sub-pixel may have the grayscale to be displayed after the row of sub-pixels are driven. After the apparatus drives the $i^{th}$ row of sub-pixels according to the test image, a potential on each data line in the display panel matches a grayscale of a sub-pixel connected to this data line in the $i^{th}$ row of sub-pixels. In the embodiment of the present disclosure, after the apparatus drives the $i^{th}$ row of sub-pixels, a grayscale displayed by each sub-pixel in the $i^{th}$ row of sub-pixels may be acquired. The grayscale displayed by each sub-pixel in the $i^{th}$ row of sub-pixels may represent a potential on a data line connected to each sub-pixel. Then, a reference grayscale of each sub-pixel in the $j^{th}$ row of the sub-pixels in each candidate connection mode is determined according to the grayscale displayed by each sub-pixel in the $i^{th}$ row of sub-pixels.

In each candidate connection mode of a plurality of data lines in the display panel, the connected data lines in the plurality of data lines have the same potential due to charge sharing. After the apparatus drives the $i^{th}$ row of sub-pixels, if the plurality of data lines are connected according to any one of the candidate connection modes, the potential on each of the at least connected two data lines in the plurality of data lines is equal to an average value of original potentials on the at least two data lines. In this case, if the $j^{th}$ row of sub-pixels are driven, the sub-pixels connected to the at least two data lines in the $j^{th}$ row of sub-pixels display the same grayscale, and the grayscale is equal to an average value of the grayscales displayed by the sub-pixels connected to the at least two data lines in the $i^{th}$ row of the sub-pixels.

Referring to FIG. 2, it is assumed that the sub-pixel group Z1 shown in FIG. 2 belongs to the $i^{th}$ row of sub-pixels, and the sub-pixel group Z2 belongs to the $j^{th}$ row of sub-pixels. After the apparatus drives the $i^{th}$ row of sub-pixels according to the test image, the grayscales of six sub-pixels sequentially arranged in an x direction in the sub-pixel group Z1 are h11, h12, h13, h14, h15, and h16. Assuming that after the apparatus drives the $i^{th}$ row of sub-pixels according to the test image and scans the gate line connected to the $j^{th}$ row of sub-pixels, then when the plurality of data lines in the display panel are connected according to the first candidate connection mode, three first data lines are connected according to the Mode s11 shown in FIG. 2, and three second data groups are connected according to the Mode s21 shown in FIG. 2 in the data line group connected to the sub-pixel group Z1. In this way, the reference grayscales of the six sub-pixels arranged in the x direction in the sub-pixel group Z2 are c11, c12, c13, c14, c15, and c16 in sequence, where c11=c13=c15=(h11+h13+h15)/3, c12=c14=c16=(h12+h14+h16)/3.

For another example, assuming that after the apparatus drives the $i^{th}$ row of sub-pixels according to the test image and scans the gate line connected to the $j^{th}$ row of sub-pixels, when the plurality of data lines in the display panel are connected according to the second candidate connection mode, three first data lines are connected according to the Mode s12 shown in FIG. 2 and three second data lines are connected according to the Mode s22 shown in FIG. 2 in the data line group corresponding to the sub-pixel group Z1. In this way, the reference grayscales of six sub-pixels sequentially arranged in the x direction in the sub-pixel group Z2 are c11, c12, c13, c14, c15, and c16 in sequence, where c11=c13=(h11+h13)/2, c12=c14=(h12+h14)/2, c15=h15, c16=h16.

In S403, a grayscale variation degree of the $j^{th}$ row of sub-pixels in each candidate connection mode is determined.

The grayscale variation degree of the $j^{th}$ row of sub-pixels is intended to characterize a total variation degree of the reference grayscale of each sub-pixel in the $j^{th}$ row of sub-pixels relative to the grayscale to be displayed. When the grayscale variation degree of the $j^{th}$ row of sub-pixels is greater, the power consumption required for the apparatus to drive the $j^{th}$ row of sub-pixels is greater.

Figure 5:
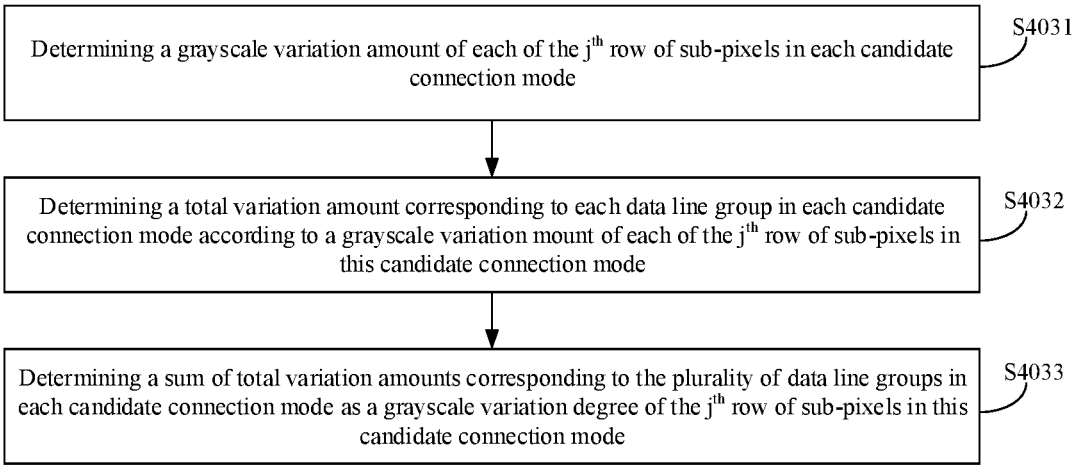
FIG. 5 is a flowchart showing the determination of a grayscale variation degree of the $j^{th}$ row of sub-pixels according to an embodiment of the present disclosure.

As shown in FIG. 5, S403 may include the following substeps.

In S4031, a grayscale variation amount of each sub-pixel in the $j^{th}$ row of sub-pixels in each candidate connection mode is determined.

The grayscale variation amount of each sub-pixel in each candidate connection mode is intended to characterize a variation amount of the reference grayscale of the sub-pixel in each candidate connection mode relative to the grayscale to be displayed.

Optionally, the apparatus may first determine a difference value between the reference grayscale of each sub-pixel in each candidate connection mode and the grayscale to be displayed in S4031. Then, it is determined whether the sub-pixel satisfies a first condition according to the difference value and the connection between the data line connected to the sub-pixel and another data line. The first condition may include: the data line connected to the sub-pixel is not connected to another data line, and an absolute value of the difference value between the reference grayscale of the sub-pixel and the grayscale to be displayed is less than or equal to a grayscale threshold. When a sub-pixel in certain candidate connection mode satisfies the first condition, the apparatus determines that the grayscale variation amount of the sub-pixel is zero. When a sub-pixel in certain candidate connection mode does not satisfy the first condition, the apparatus determines that the grayscale variation amount of the sub-pixel is the difference value of the sub-pixel in this candidate connection mode.

Exemplarily, continuing to FIG. 2, it is assumed that the sub-pixel group Z1 belongs to the $i^{th}$ row of sub-pixels, and the sub-pixel group Z2 belongs to the $j^{th}$ row of sub-pixels. The grayscales to be displayed of six sub-pixels sequentially arranged in the x direction in the sub-pixel group Z2 are h21, h22, h23, h24, h25, and h26. The reference grayscales of these six sub-pixels in the second candidate connection mode are c11, c12, c13, c14, c15, and c16 in sequence. In addition, when a plurality of data lines are connected according to the second candidate connection mode, three first data lines are connected according to the Mode s12 shown in FIG. 2, and three second data lines are connected according to the Mode s22 shown in FIG. 2. As known from FIG. 2, in the second candidate connection mode, a data line connected to the first four sub-pixels arranged in the x direction in the sub-pixel group Z2 are connected to another data line. Therefore, the apparatus may determine that the grayscale variation amounts of the first four sub-pixels are c11-h21, c12-h22, c13-h23, and c14-h24 in the second candidate connection mode, respectively. As known from FIG. 2, in this second candidate connection mode, a data line connected to the last two sub-pixels arranged in the x direction in the sub-pixel group Z2 are not connected to another data line. In this case, if an absolute value of c15-h25 is greater than the grayscale threshold, the apparatus determines that the fifth sub-pixel does not satisfy the first condition, and further determines that the grayscale variation amount of the fifth sub-pixel in the second candidate connection mode is c15-h25. If the absolute value is less than or equal to the grayscale threshold, the apparatus determines that the fifth sub-pixel satisfies the first condition, and further determines that the grayscale variation amount of the fifth sub-pixel in the second candidate connection mode is zero. A manner for determining the grayscale variation amount of the sixth sub-pixel in the second candidate connection mode may refer to the manner for determining the grayscale variation amount of the fifth sub-pixel in the second candidate connection mode, which is not described herein any further in the embodiment of the present disclosure.

Optionally, this grayscale threshold may be set according to a calculation speed requirement on the grayscale variation amount, a power consumption requirement on the display panel, and other requirements. For example, when the calculation speed for the grayscale variation amount is required to be relatively fast, the grayscale threshold may be set to be relatively large. When the calculation speed for the grayscale variation amount is required to be relatively slow, the grayscale threshold may be set to be relatively small. When the power consumption of the display panel is required to be relatively low, the grayscale threshold may be set to be relatively large. When the power consumption of the display panel is required to be relatively high, the grayscale threshold may be set to be relatively small.

Optionally, the grayscale threshold may be 20. The grayscale threshold may also be 10, 30, or other values, which is not limited in the embodiment of the present disclosure.

It should be noted that when a sub-pixel satisfies the first condition in the embodiment of the present disclosure, the apparatus may directly determine that the grayscale variation amount of the sub-pixel is zero. Since the absolute value of the difference value between the reference grayscale of the sub-pixel and the grayscale to be displayed is not greater than the threshold, the difference value has a small influence on the calculation of the target connection mode. In this case, the difference value is directly set to zero, which can avoid the calculation for the difference value in the subsequent calculation process, thereby reducing the calculation amount required to determine the target connection mode and improving the calculation efficiency.

In S4032, a total variation amount corresponding to each data line group in each candidate connection mode is determined according to the grayscale variation mount of each sub-pixel in the $j^{th}$ row of sub-pixels in each candidate connection mode.

Optionally, the apparatus may determine an absolute value of a sum of grayscale variation amounts of respective sub-pixels connected to each data line group in the $j^{th}$ row of sub-pixels, in each candidate connection mode as the total variation amount corresponding to the data line group in this candidate connection mode.

Exemplarily, assuming that the grayscale variation amounts of the six sub-pixels in the sub-pixel group Z2 are respectively k1, k2, k3, k4, k5, and k6 in the second candidate connection mode, the total variation amount corresponding to the data line group connected to the sub-pixel group Z2 in the second candidate connection mode is an absolute value of k1+k2+k3+k4+k5+k6.

In S4033, a sum of total variation amounts corresponding to a plurality of data line groups in each candidate connection mode is determined as a grayscale variation degree of the $j^{th}$ row of sub-pixels in the candidate connection mode.

Exemplarily, it is assumed that the display panel includes a total of three data line groups. In a candidate connection mode, the total variation amounts corresponding to the three data line groups respectively are: a total variation amount 1, a total variation amount 2 and a total variation mount 3.

Then, the grayscale variation degree of the $j^{th}$ row of sub-pixels in this candidate connection mode can be expressed as: total variation amount 1+total variation amount 2+total variation amount 3.

In the embodiment of the present disclosure, with respect to each candidate connection mode of a plurality of data lines in the display panel, the above S4031 to S4033 are performed, and the grayscale variation degree of the $j^{th}$ row of sub-pixels in each candidate connection mode can be obtained. After S403, a plurality of grayscale variation degrees in one-to-one correspondence to the plurality of candidate connection modes may be obtained.

In S404, a target connection mode that minimizes the grayscale variation degree of the $j^{th}$ row of sub-pixels is determined from the plurality of candidate connection modes of the plurality of data lines.

Exemplarily, the apparatus may compare the magnitudes of the plurality of grayscale variation degrees of the $j^{th}$ row of sub-pixels obtained in S403 to determine the minimum grayscale variation degree from the plurality of grayscale variation degrees, and further determine the candidate connection mode corresponding to the minimum grayscale variation degree as the target connection mode.

Optionally, upon determining the target connection mode, the apparatus may store the target connection mode. In the embodiment of the present disclosure, the data lines in respective data line groups in the target connection mode are connected in the same way. Therefore, the apparatus may store the target connection mode by storing the connection mode of the data lines in any data line group in the target connection mode. Hence, a storage speed can be accelerated to prevent a storage space from being excessively occupied.

In S405, a gate line connected to the $i^{th}$ row of sub-pixels is scanned according to a target image, and the $i^{th}$ row of sub-pixels are driven through a plurality of data lines.

In S406, the plurality of data lines in the display panel are connected according to the target connection mode.

The target image is different from the test image. For example, the target image may be a next frame image of the test image. That is, the target image and the test image are two adjacent images. Since the difference between two adjacent images is usually small, the target connection mode determined according to the test image may also be applied in a display process of the target image. Optionally, the target image and the test image may not be two adjacent images, which is limited in the embodiment of the present disclosure.

It should be noted that the apparatus may sequentially drive a plurality of rows of sub-pixels according to each image. The apparatus may also drive the $j^{th}$ row of sub-pixels according to the test image upon driving the $i^{th}$ row of sub-pixels according to the test image. In addition, upon driving the $i^{th}$ row of sub-pixels according to the target image, the apparatus may read the previously stored target connection mode from the storage space of the display device, and connect the plurality of data lines in the display panel according to the target connection mode, so as to drive the $j^{th}$ row of sub-pixels according to the target image in S408 after the plurality of data lines are disconnected in S407.

Optionally, if the target connection mode can be determined before the $j^{th}$ row of sub-pixels are driven according to the test image, S405 may not be performed. In S406, the plurality of data lines in the display panel may also be connected according to the target connection mode before the $j^{th}$ row of sub-pixels are driven according to the test image.

In the embodiment of the present disclosure, the display panel may further include a control circuit. The apparatus may control the respective data line in the display panel to be connected according to the target connection mode through the control circuit.

Figure 6:
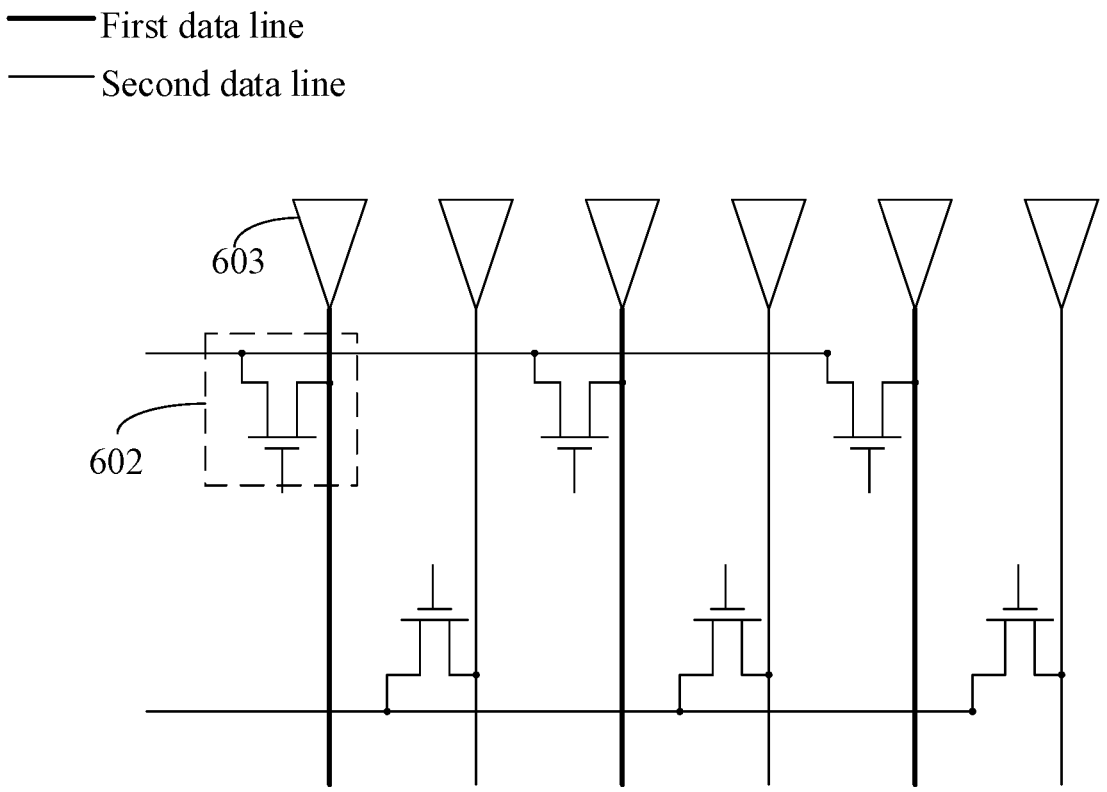
FIG. 6 is a schematic structural diagram showing a part of a control circuit in a display panel according to an embodiment of the present disclosure.

FIG. 6 is a schematic structural diagram showing a part of a control circuit in a display panel according to an embodiment of the present disclosure. It should be noted that FIG. 6 shows only six data lines in the display panel. In addition, FIG. 6 gives an illustration by taking an arrangement mode of these six data lines being the first type of arrangement modes described above as an example. As shown in FIG. 6, the control circuit in the display panel may include a plurality of transistors 602 and a plurality of power amplifiers 603. The plurality of transistors 602 are connected to a plurality of data lines (including a plurality of first data lines and a plurality of second data lines) in the display panel in a one-to-one corresponding manner. The plurality of power amplifiers 603 are connected to a plurality of data lines in the display panel in a one-to-one corresponding manner. Each data line 601 is connected to a first pole of the transistor 602 corresponding thereto. Second poles of the transistors 602 corresponding to respective first data lines in the plurality of data lines 601 are connected, and second poles of the transistors 602 corresponding to respective second data lines in the plurality of data lines 601 are connected. The first pole of each transistor 602 is a source electrode, and the second pole of the transistor 602 is a drain electrode. Alternatively, the first pole of each transistor 602 is the drain electrode, and the second pole of the transistor 602 is the source electrode.

Upon determining the target connection mode, the apparatus for driving the display panel may determine data lines that need to be connected in the display panel according to the target connection mode, and then send a control signal to the gate electrode of the transistor corresponding to these data lines, such that the transistor is turned on, and these data lines are further communicated. It should be noted that lines for sending the control signals to the gate electrodes of the transistors are not illustrated in FIG. 6.

Exemplarily, it is assumed that the data lines controlled by the control circuit shown in FIG. 6 is shown in FIG. 2, and in the target connection mode, the first data lines are connected according to the Mode s11 in FIG. 2, and the second data lines are connected according to the Mode s21 in FIG. 2. Then, when the apparatus for driving the display panel controls a plurality of data lines to be connected according to the target connection mode, it is necessary to send the control signal to the gate electrode of each of the six transistors in FIG. 6, such that the six transistors are all in a turned-on state. Therefore, the three first data lines in FIG. 6 are connected, and the three second data lines in FIG. 6 are connected.

Optionally, in the embodiment of the present disclosure, the apparatus for driving the display panel may not perform S403 to step 405 either, but may determine an auxiliary connection mode that minimizes the grayscale variation degree of the sub-pixels connected to each data line group from the plurality of connection modes of the data lines in each data line group, thereby further connecting the data lines in the data line group directly according to the auxiliary connection mode.

The grayscale variation degree of the sub-pixels connected to the data line group is intended to characterize a total variation degree of the reference grayscale of each sub-pixel connected to the sub-pixel group relative to a grayscale to be displayed. The grayscale variation degree of the sub-pixels connected to the data line group may be the total variation amount corresponding to the data line group, which is not described herein any further in the embodiment of the present disclosure.

In S407, a plurality of data lines in the display panel are disconnected.

In S408, a gate line connected to the $j^{th}$ row of sub-pixels is scanned according to a target image, and the $j^{th}$ row of sub-pixels are driven through a plurality of data lines.

When driving the $j^{th}$ row of sub-pixels according to the target image, the apparatus may adjust potentials on the plurality of data lines according to the grayscale to be displayed of each sub-pixel in the $j^{th}$ row of sub-pixels, such that each sub-pixel have its grayscale to be displayed.

It should be noted that after the plurality of data lines in the display panel are connected according to the target mode method, the interconnected data lines in the plurality of data lines have the same potential due to charge sharing. In this way, when the apparatus drives the $j^{th}$ row of sub-pixels, the total adjustment amount of the potentials on the plurality of data lines is relatively small. Therefore, the power consumption required for the apparatus to adjust the potentials on the data lines is reduced.

Figure 7:
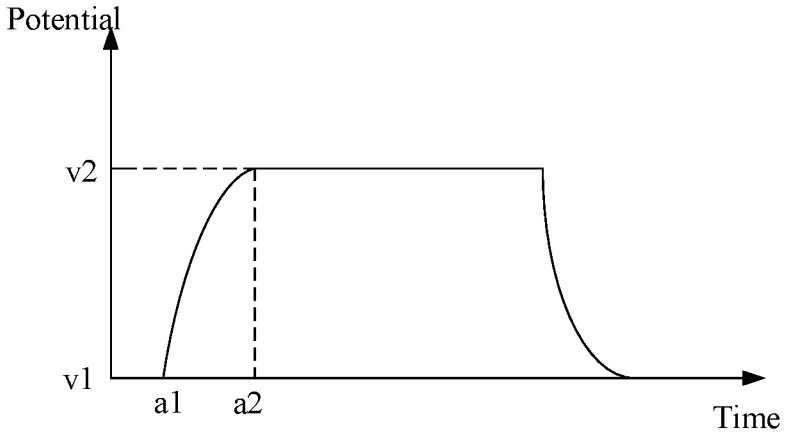
FIG. 7 (Prior Art)
FIG. 7 is a timing diagram of a potential variation of data lines in the related art.
Figure 8:
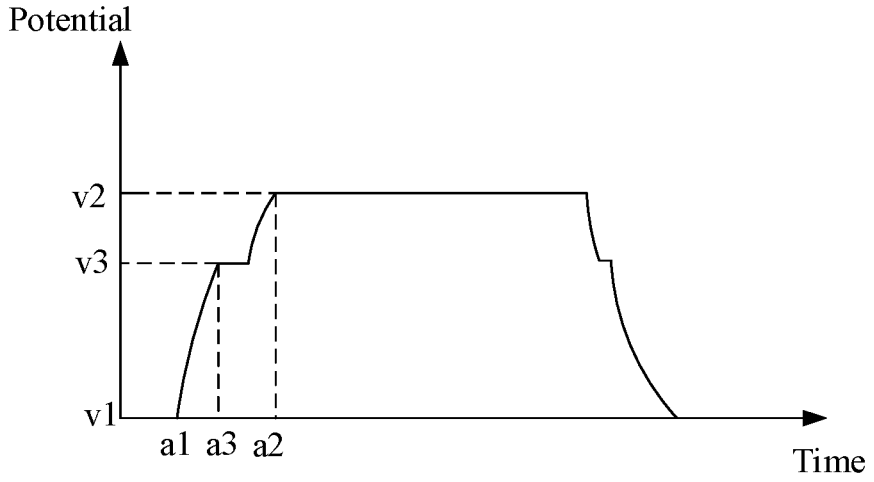
FIG. 8 is a timing diagram of a potential variation of data lines according to an embodiment of the present disclosure.

Exemplarily, FIG. 7 is a timing diagram of a potential variation of data lines in the related art. FIG. 8 is a timing diagram of a potential variation of data lines according to embodiments of the present disclosure. In FIG. 7 and FIG. 8, the apparatus ends driving the $i^{th}$ row of sub-pixels in the display panel at Time a1, and the potential on the data lines is v1 at this time; the apparatus starts driving the $j^{th}$ row of sub-pixels at Time a2, and the potential on the data lines is v2 at this time. In FIG. 8, the apparatus connects the plurality of data lines in the display panel according to the target connection mode at Time a3, and the potential on the data lines may be increased from v1 to v3 at this time.

As known from the timing diagram shown in FIG. 7, in the related art, the potential on the data lines needs to be increased by v2−v1 between Time a1 and Time a2. That is, before the $j^{th}$ row of sub-pixels are driven, the charging amount for the pixels connected to the data lines is v2−v1. However, in the embodiment of the present disclosure, since the apparatus connects the plurality of data lines in the display panel according to the target connection mode at Time a3, and the sub-pixels are not required to be charged in the connection process, the charging amount for the apparatus to charge the sub-pixels connected to the data lines is v2−v3 before the $j^{th}$ row of sub-pixels are driven. v2−v3 is less than v2−v1 (such as v2−v3 is approximately equal to one-third of v2−v1). Therefore, the method for driving the display panel according to the embodiment of the present disclosure can reduce the charging amount for the apparatus to charge the sub-pixels, and reduce the power consumption required for the apparatus to drive the display panel to display an image.

In summary, in the method for driving the display panel according to the embodiment of the present disclosure, a plurality of data lines in the display panel may be connected according to the target connection mode before the $j^{th}$ row of sub-pixels are driven. Since the potentials of the interconnected data lines in the plurality of data lines are the same, the potential on the interconnected data lines may vary in advance before the $j^{th}$ row of sub-pixels are driven, thereby achieving an effect of pre-charging the $j^{th}$ row of sub-pixels. In the process of driving the $j^{th}$ row of sub-pixels, the potential on the plurality of data lines varies slightly. Therefore, the power consumption for the apparatus to drive the $j^{th}$ row of sub-pixels is reduced.

Further, the target connection mode is a candidate connection mode that minimizes the grayscale variation degree of the $j^{th}$ row of sub-pixels in the plurality of candidate connection modes. When the plurality of data lines are connected according to the target connection mode, the $j^{th}$ row of sub-pixels is pre-charged to the greatest extent, thereby minimizing the power consumption required to drive the $j^{th}$ row of sub-pixels.

In addition, in the embodiment of the present disclosure, the target connection mode corresponding to each row of sub-pixels may be determined according to a grayscale to be displayed of this row of sub-pixels. Therefore, the connection mode of the data lines may be flexibly adjusted for each row of sub-pixels in the display panel, such that the display panel is driven more flexibly to display an image. For each row of sub-pixels, the data lines are connected according to the target connection mode that minimizes the grayscale variation degree of the sub-pixels. Therefore, the overall power consumption required for the apparatus to drive the display panel to display the image is relatively low.

Figure 9:
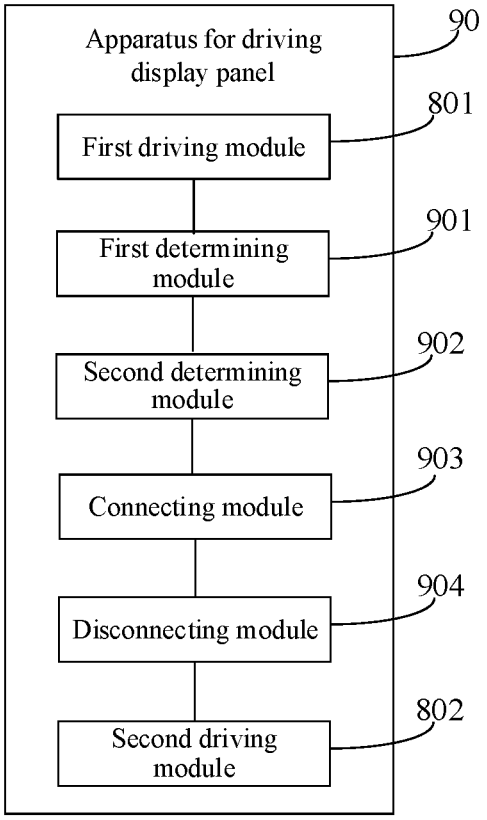
FIG. 9 is a schematic structural diagram of an apparatus for driving a display panel according to an embodiment of the present disclosure.

FIG. 9 is a schematic structural diagram of an apparatus 90 for driving a display panel according to an embodiment of the present disclosure. As shown in FIG. 9, the apparatus 90 for driving the display panel may include:

a first driving module 801, configured to scan a gate line connected to an $i^{th}$ row of sub-pixels, and drive the $i^{th}$ row of sub-pixels through a plurality of data lines of the display panel, where $i \geq 1$;

a first determining module 901, configured to scan a gate line connected to a $j^{th}$ row of sub-pixels, and determine a reference grayscale of each sub-pixel in the $j^{th}$ row in each candidate connection mode, wherein the display panel includes the plurality of data lines, the plurality of data lines have a plurality of candidate connection modes, and the $i^{th}$ row of sub-pixels and the $j^{th}$ row of sub-pixels are two rows of sub-pixels which are sequentially driven in the display panel, where $j \geq 1$;

a second determining module 902, configured to determine a target connection mode that minimizes a grayscale variation degree of the $j^{th}$ row of sub-pixels from the plurality of candidate connection modes, wherein the grayscale variation degree is intended to characterize a total variation degree of the reference grayscale of each of the $j^{th}$ row of sub-pixels relative to a grayscale to be displayed;

a connecting module 903, configured to connect the plurality of data lines according to the target connection mode;

a disconnecting module 904, configured to disconnect the plurality of data lines before scanning the $j^{th}$ row of sub-pixels; and a second driving module 802, configured to drive the $j^{th}$ row of sub-pixels through the plurality of data lines.

In summary, in the apparatus for driving the display panel according to the embodiment of the present disclosure, the connecting module may connect the plurality of data lines in the display panel according to the target connection mode before the second driving module drives the $j^{th}$ row of sub-pixels. Since the potentials of the interconnected data lines in the plurality of data lines are the same, the potential on the interconnected data lines may vary in advance before the second driving module drives the $j^{th}$ row of sub-pixels, thereby achieving an effect of pre-charging the $j^{th}$ row of sub-pixels. Further, when the second driving module drives the $j^{th}$ row of sub-pixels, the potentials on the plurality of data lines vary slightly. Therefore, the power consumption required to drive the $j^{th}$ row of sub-pixels is reduced.

Further, the target connection mode is a candidate connection mode that minimizes the grayscale variation degree of the $j^{th}$ row of sub-pixels in the plurality of candidate connection modes. When a plurality of data lines are connected according to this target connection mode, the $j^{th}$ row of sub-pixels can be pre-charged to the greatest extent, thereby minimizing the power consumption required to drive the $j^{th}$ row of sub-pixels.

In addition, in the embodiment of the present disclosure, the target connection mode corresponding to each row of sub-pixels may be determined according to a grayscale to be displayed of the row of sub-pixels. Therefore, the connection mode of the data lines may be flexibly adjusted for each row of sub-pixels in the display panel, such that the display panel is driven more flexibly to display the image. For each row of sub-pixels, the data lines are connected according to the target connection mode that minimizes the grayscale variation degree of the sub-pixels. Therefore, the overall power consumption required for the apparatus to drive the display panel to display the image is relatively low.

Optionally, the plurality of data lines include a plurality of data line groups arranged in sequence, wherein each data line group includes at least two data lines. In each candidate connection mode, any two connected data lines belong to the same data line group.

Optionally, in each candidate connection mode, the data lines in each data line group are connected in the same fashion.

Figure 10:
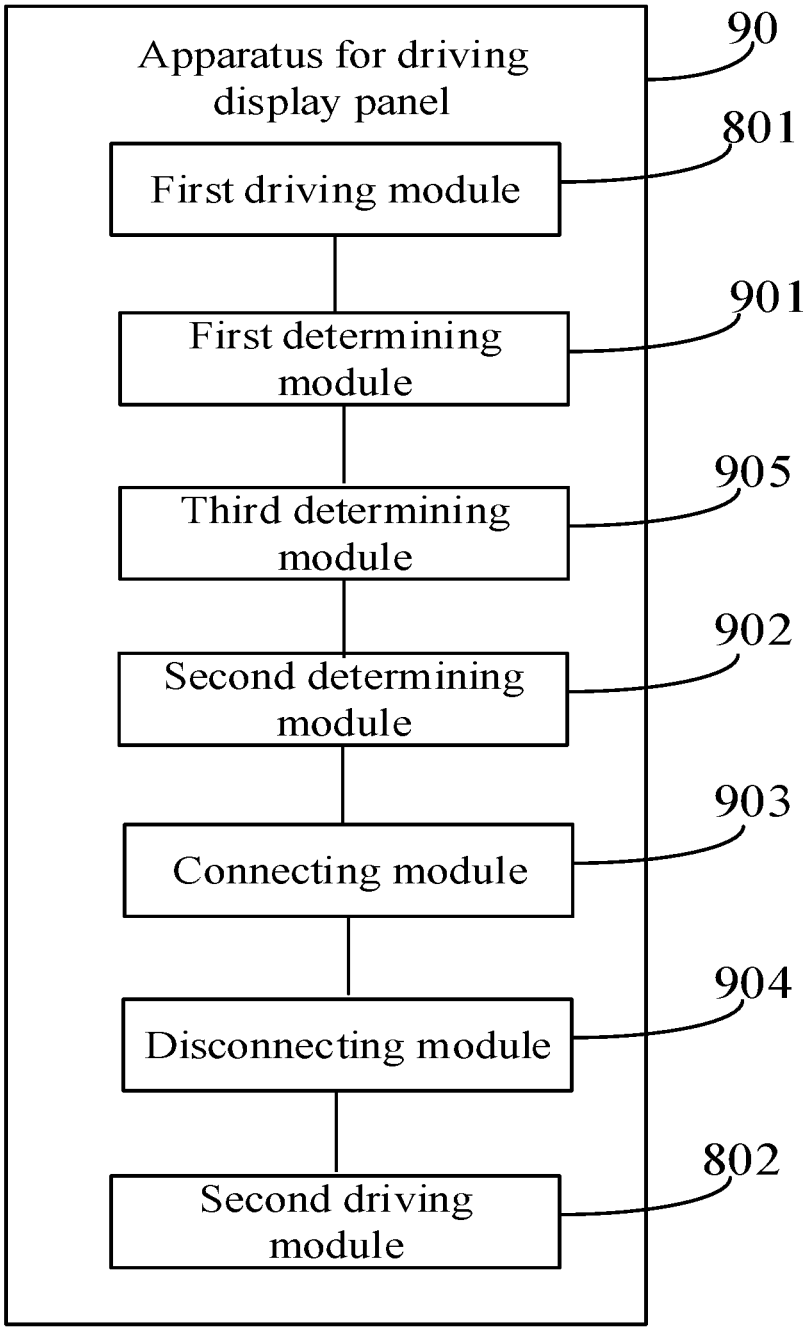
FIG. 10 is a schematic structural diagram of another apparatus for driving a display panel according to an embodiment of the present disclosure.

Optionally, FIG. 10 is a schematic structural diagram of another apparatus 90 for driving a display panel according to an embodiment of the present disclosure. As shown in FIG. 10, based on FIG. 9, the apparatus 90 for driving the display panel may further include:

a third determining module 905, configured to determine a sum of total variation amounts corresponding to the plurality of data line groups in each candidate connection mode as a grayscale variation degree of the $j^{th}$ row of sub-pixels in each candidate connection mode;

the total variation amount corresponding to each data line group is an absolute value of a sum of grayscale variation amounts of the respective sub-pixels connected to the data line group; and the grayscale variation amount of each sub-pixel is intended to characterize a variation amount of the reference grayscale of the sub-pixel relative to the grayscale to be displayed.

Figure 11:
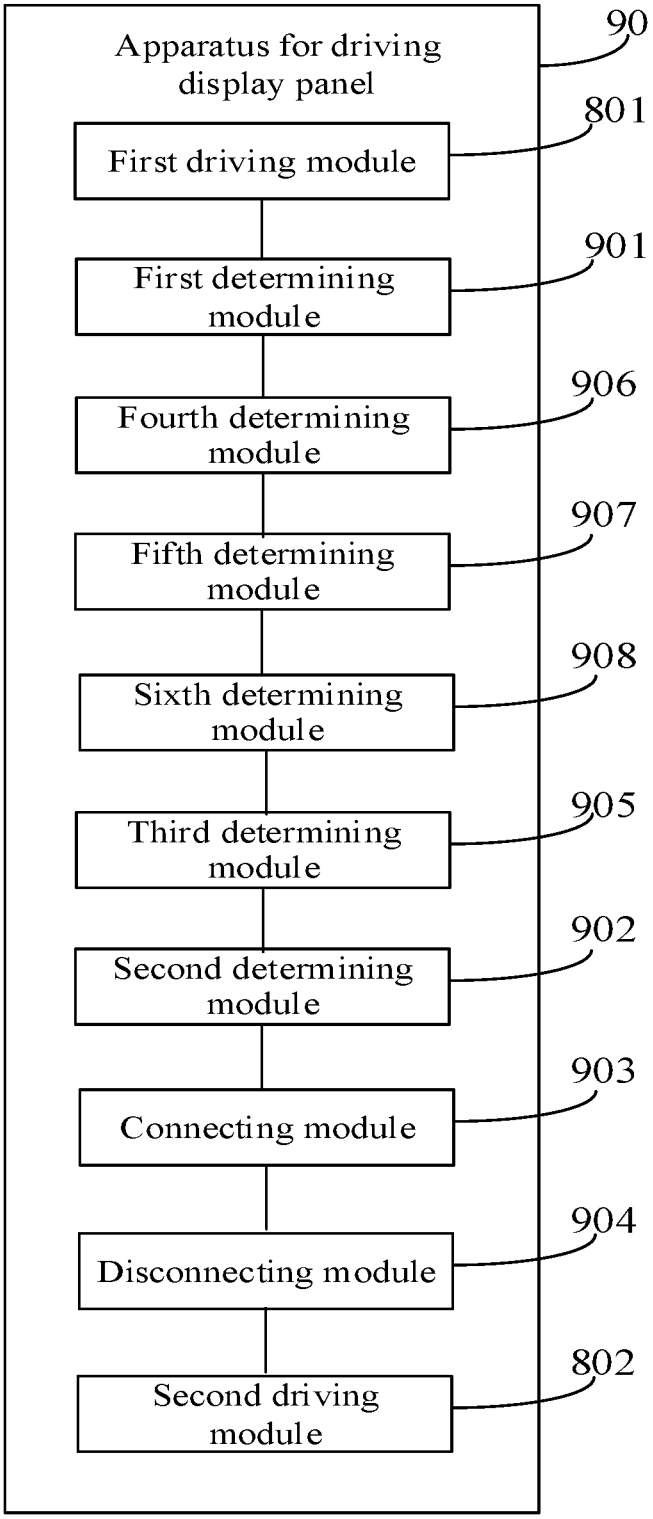
FIG. 11 is a schematic structural diagram of yet another apparatus for driving a display panel according to an embodiment of the present disclosure.

Optionally, FIG. 11 is a schematic structural diagram of yet another apparatus 90 for driving a display panel according to an embodiment of the present disclosure. As shown in FIG. 11, based on FIG. 10, the apparatus 90 for driving the display panel may further include:

a fourth determining module 906, configured to determine a difference value between the reference grayscale of each sub-pixel in each candidate connection mode and the grayscale to be displayed;

a fifth determining module 907, configured to determine that a grayscale variation amount of each sub-pixel in the candidate connection mode is zero when the sub-pixel satisfies a first condition; and a sixth determining module 908, configured to determine a grayscale variation amount of each sub-pixel in the candidate connection mode as the difference value when the sub-pixel does not satisfy the first condition.

The first condition includes that the data line connected to each sub-pixel in this candidate connection mode is not connected to another data line, and an absolute value of the difference value is less than or equal to a grayscale threshold.

Optionally, each data line group includes a plurality of first data lines and a plurality of second data lines, the first data lines being configured to load a potential of a positive polarity, and the second data lines being configured to load a potential of a negative polarity.

In each candidate connection mode, each data line group satisfies at least one of the following conditions:

at least two first data lines in the data line group are connected; and at least two second data lines in the data line group are connected.

Optionally, each data line group includes three first data lines and three second data lines.

Optionally, each data line group is connected to sub-pixels in a pixel adjacent thereto, and the pixel includes a plurality of sub-pixels.

Optionally, the first driving module 801 is configured to scan a gate line connected to the $i^{th}$ row of sub-pixels according to a test image, and drive the $i^{th}$ row of sub-pixels through the plurality of data lines.

The first determining module 901 is configured to scan a gate line connected to the $j^{th}$ row of sub-pixels according to the test image.

The connecting module 903 is configured to scan the gate line connected to the $i^{th}$ row of sub-pixels according to a target image, drive the $i^{th}$ row of sub-pixels through the plurality of data lines, and then connect the plurality of data lines according to the target connection mode, wherein the target image is different from the test image.

The second driving module 802 is configured to scan the gate line connected to the $j^{th}$ row of sub-pixels according to the target image, and drive the $j^{th}$ row of sub-pixels through the plurality of data lines.

Optionally, the target image is a next frame image of the test image.

In summary, in the apparatus for driving the display panel according to the embodiment of the present disclosure, the connecting module may connect the plurality of data lines in the display panel according to the target connection mode before the second driving module drives the $j^{th}$ row of sub-pixels. Since the potentials on the interconnected data lines in the plurality of data lines are the same, the potential on the interconnected data lines may vary in advance before the second driving module drives the $j^{th}$ row of sub-pixels, thereby achieving an effect of pre-charging the $j^{th}$ row of sub-pixels. Further, when the second driving module drives the $j^{th}$ row of sub-pixels, the potential on the plurality of data lines varies slightly. Therefore, the power consumption required for drive the $j^{th}$ row of sub-pixels is reduced.

Further, the target connection mode is a candidate connection mode that minimizes the grayscale variation degree of the $j^{th}$ row of sub-pixels in the plurality of candidate connection modes. When a plurality of data lines are connected according to this target connection mode, the $j^{th}$ row of sub-pixels are pre-charged to the greatest extent, thereby minimizing the power consumption required to drive the $j^{th}$ row of sub-pixels.

In addition, in the embodiment of the present disclosure, the target connection mode corresponding to each row of sub-pixels may be determined according to a grayscale to be displayed of this row of sub-pixels. Therefore, the connection mode of the data lines may be flexibly adjusted for each row of sub-pixels in the display panel, such that the display panel is driven more flexibly to display an image. For each row of sub-pixels, the data lines are connected according to the target connection mode that minimizes the grayscale variation degree of the sub-pixels. Therefore, the overall power consumption required for the apparatus to drive the display panel to display the image is relatively low.

An embodiment of the present disclosure further provides an apparatus for use in driving a display panel. The apparatus includes a processor and a memory. The processor is configured to run a program stored in the memory to perform any one of the methods for driving the display panel according to the embodiments of the present disclosure.

An embodiment of the present disclosure further provides a computer-readable storage medium. The computer-readable storage memory is configured to store a computer program therein, which, when being run by a processor, enables the processor to perform any one of the methods for driving the display panel according to the embodiments of the present disclosure.

An embodiment of the present disclosure further provides a computer program product, which, when being run on a computer, enables the computer to perform any one of the methods for driving the display panel according to the embodiments of the present disclosure.

An embodiment of the present disclosure provides a display device. The display device may include a display panel and any one of the apparatuses for driving the display panel (e.g., the apparatus shown in FIG. 9 or FIG. 10) according to the embodiments of the present disclosure. Optionally, the apparatus may be a driving integrated circuit chip.

Optionally, the display device according to the embodiment of the present disclosure may be any product or component having a display function, such as a mobile phone, a tablet computer, a television, a display, a notebook computer, a digital photo frame, a navigator, or the like.

It should be noted that the apparatus for driving the display panel according to the above embodiments only takes division of all the functional modules as an example for explanation when driving the display panel. In practice, the above functions can be implemented by the different functional modules as required. That is, the internal structure of the apparatus is divided into different functional modules to implement all or part of the functions described above.

It should be noted that the method embodiments and the corresponding apparatus embodiments of the present disclosure may be cross referenced, which is not limited in the embodiments of the present disclosure. The sequence of the operations in the method embodiments of the present disclosure may be adjusted appropriately, and the operations may be deleted or added according to the actual situations. Within the technical scope of the present disclosure, any variations of the method readily derived by a person of ordinary skill in the art shall fall within the protection scope of the present disclosure, which is not repeated herein.

Described above are merely optional embodiments of the present disclosure, and are not intended to limit the present disclosure. Within the spirit and principles of the disclosure, any modifications, equivalent substitutions, improvements or the like are within the protection scope of the present disclosure.

What is claimed is:

1. A method for driving a display panel, comprising:

scanning a gate line connected to an $i^{th}$ row of sub-pixels, and driving the $i^{th}$ row of sub-pixels through a plurality of data lines of the display panel, where $i \geq 1$;

scanning a gate line connected to a $j^{th}$ row of sub-pixels, and determining a reference grayscale of each of the $j^{th}$ row of sub-pixels in each candidate connection mode, wherein the plurality of data lines have a plurality of candidate connection modes, and the $i^{th}$ row of sub-pixels and the $j^{th}$ row of sub-pixels are two rows of sub-pixels which are sequentially driven in the display panel, where $j \geq 1$;

determining a target connection mode that minimizes a grayscale variation degree of the $j^{th}$ row of sub-pixels from the plurality of candidate connection modes, wherein the grayscale variation degree is intended to characterize a total variation degree of the reference grayscale of each of the $j^{th}$ row of sub-pixels relative to a grayscale to be displayed;

connecting the plurality of data lines according to the target connection mode;

disconnecting the plurality of data lines; and driving the $j^{th}$ row of sub-pixels through the plurality of data lines, wherein the plurality of data lines comprise a plurality of data line groups arranged in sequence, each data line group comprising at least two data lines; and in each candidate connection mode, any two connected data lines belong to the same data line group; and prior to determining the target connection mode that minimizes the grayscale variation degree of the $j^{th}$ row of sub-pixels, the method further comprises:

determining a sum of total variation amounts corresponding to the plurality of data line groups in each candidate connection mode as the grayscale variation degree of the $j^{th}$ row of sub-pixels in each candidate connection mode, and wherein the total variation amount corresponding to each data line group is an absolute value of a sum of grayscale variation amounts of the respective sub-pixels connected to the data line group; and the grayscale variation amount of each sub-pixel is intended to characterize a variation amount of the reference grayscale of the sub-pixel relative to the grayscale to be displayed.

2. The method according to claim 1, wherein upon determining the reference grayscale of each of the $j^{th}$ row of sub-pixels in each candidate connection mode, the method further comprises:

determining a difference value between the reference grayscale of each sub-pixel in each candidate connection mode and the grayscale to be displayed;

determining that the grayscale variation amount of each sub-pixel in each of the candidate connection modes is zero if each sub-pixel satisfies a first condition; and determining the grayscale variation amount of each sub-pixel in each candidate connection mode as the difference value if each sub-pixel does not satisfy the first condition;

wherein the first condition comprises that the data line connected to each sub-pixel in each candidate connection mode is not connected to another data line, and an absolute value of the difference value is less than or equal to a grayscale threshold.

3. The method according to claim 2, wherein the $j^{th}$ row of sub-pixels are the first row of sub-pixels which are driven after the $i^{th}$ row of sub-pixels are driven; in each candidate connection mode, the data lines in the respective data line groups are connected in the same fashion, and each data line group is connected to sub-pixels in a pixel adjacent thereto; the pixel comprises a plurality of sub-pixels;

each data line group comprises three first data lines and three second data lines, the first data lines being configured to load a potential of a positive polarity, and the second data lines being configured to load a potential of a negative polarity; in each candidate connection mode, each data line group satisfies at least one of the following conditions: at least two first data lines in the data line group are connected; and at least two second data lines in the data line group are connected;

scanning the gate line connected to the $i^{th}$ row of sub-pixels and driving the $i^{th}$ row of sub-pixels through the plurality of data lines comprises:

scanning the gate line connected to the $i^{th}$ row of sub-pixels according to a test image, and driving the $i^{th}$ row of sub-pixels through the plurality of data lines;

scanning the gate line connected to the $j^{th}$ row of sub-pixels comprises:

scanning the gate line connected to the $j^{th}$ row of sub-pixels according to the test image;

connecting the plurality of data lines according to the target connection mode comprises:

scanning the gate line connected to the $i^{th}$ row of sub-pixels according to a target image, driving the $i^{th}$ row of sub-pixels through the plurality of data lines, and then connecting the plurality of data lines according to the target connection mode, the target image being different from the test image; and driving the $j^{th}$ row of sub-pixels through the plurality of data lines comprises:

scanning the gate line connected to the $j^{th}$ row of sub-pixels according to the target image, and driving the $j^{th}$ row of sub-pixels through the plurality of data lines.

4. The method according to claim 1, wherein scanning the gate line connected to the $i^{th}$ row of sub-pixels and driving the $i^{th}$ row of sub-pixels through the plurality of data lines in the display panel comprises:

scanning the gate line connected to the $i^{th}$ row of sub-pixels according to a test image, and driving the $i^{th}$ row of sub-pixels through the plurality of data lines;

scanning the gate line connected to the $j^{th}$ row of sub-pixels comprises:

scanning the gate line connected to the $j^{th}$ row of sub-pixels according to the test image;

connecting the plurality of data lines according to the target connection mode comprises:

scanning the gate line connected to the $i^{th}$ row of sub-pixels according to a target image, driving the $i^{th}$ row of sub-pixels through the plurality of data lines, and then connecting the plurality of data lines according to the target connection mode, the target image being different from the test image; and driving the $j^{th}$ row of sub-pixels through the plurality of data lines comprises:

scanning the gate line connected to the $j^{th}$ row of sub-pixels according to the target image, and driving the $j^{th}$ row of sub-pixels through the plurality of data lines.

5. The method according to claim 4, wherein the target image is a next frame image of the test image.

6. The method according to claim 1, wherein in each candidate connection mode, the data lines in each data line group are connected in the same fashion.

7. The method according to claim 1, wherein each data line group comprises a plurality of first data lines and a plurality of second data lines, the first data lines being configured to load a potential of a positive polarity, and the second data lines being configured to load a potential of a negative polarity; and in each candidate connection mode, each data line group satisfies at least one of the following conditions:

at least two first data lines in the data line group are connected; and at least two second data lines in the data line group are connected.

8. The method according to claim 7, wherein each data line group comprises three first data lines and three second data lines.

9. The method according to claim 1, wherein each data line group is connected to sub-pixels in a pixel adjacent thereto, and the pixel comprises a plurality of sub-pixels.

10. An apparatus for driving a display panel, wherein the apparatus is configured to perform the method as defined in claim 1.

11. The apparatus for driving the display panel according to claim 10, wherein the plurality of data lines comprise a plurality of data line groups arranged in sequence, each data line group comprising at least two data lines; and in each candidate connection mode, any two connected data lines belong to the same data line group; wherein the $j^{th}$ row of sub-pixels are the first row of sub-pixels which are driven after the $i^{th}$ row of sub-pixels are driven; in each candidate connection mode, the data lines in the respective data line groups are connected in the same fashion, and each data line group is connected to sub-pixels in a pixel adjacent thereto; the pixel comprises a plurality of sub-pixels;

each data line group comprises three first data lines and three second data lines, the first data lines being configured to load a potential of a positive polarity, and the second data lines being configured to load a potential of a negative polarity; in each candidate connection mode, each data line group satisfies at least one of the following conditions: at least two first data lines in the data line group are connected; and at least two second data lines in the data line group are connected;

wherein the apparatus is configured to:

determine a sum of total variation amounts corresponding to the plurality of data line groups in each candidate connection mode as the grayscale variation degree of the $j^{th}$ row of sub-pixels in each candidate connection mode; wherein the total variation amount corresponding to each data line group is an absolute value of a sum of grayscale variation amounts of the respective sub-pixels connected to the data line group; and the grayscale variation amount of each sub-pixel is intended to characterize a variation amount of the reference grayscale of the sub-pixel relative to the grayscale to be displayed;

determine a difference value between the reference grayscale of each sub-pixel in each candidate connection mode and the grayscale to be displayed;

determine that the grayscale variation amount of each sub-pixel in each of the candidate connection modes is zero if each sub-pixel satisfies a first condition; and determine the grayscale variation amount of each sub-pixel in each candidate connection mode as the difference value if each sub-pixel does not satisfy the first condition;

wherein the first condition comprises that the data line connected to each sub-pixel in each candidate connection mode is not connected to another data line, and an absolute value of the difference value is less than or equal to a grayscale threshold;

scan the gate line connected to the $i^{th}$ row of sub-pixels according to a test image, and driving the $i^{th}$ row of sub-pixels through the plurality of data lines;

scan the gate line connected to the $j^{th}$ row of sub-pixels according to the test image;

scan the gate line connected to the $i^{th}$ row of sub-pixels according to a target image, drive the $i^{th}$ row of sub-pixels through the plurality of data lines, and then connect the plurality of data lines according to the target connection mode, the target image being different from the test image; and scan the gate line connected to the $j^{th}$ row of sub-pixels according to the target image, and drive the $j^{th}$ row of sub-pixels through the plurality of data lines.

12. A display device, comprising a display panel and an apparatus for driving a display panel; wherein the apparatus for driving the display panel is configured to perform the method as defined in claim 1.

13. The display device according to claim 12, wherein the plurality of data lines comprise a plurality of data line groups arranged in sequence, each data line group comprising at least two data lines; and in each candidate connection mode, any two connected data lines belong to the same data line group; wherein the $j^{th}$ row of sub-pixels are the first row of sub-pixels which are driven after the $i^{th}$ row of sub-pixels are driven; in each candidate connection mode, the data lines in the respective data line groups are connected in the same fashion, and each data line group is connected to sub-pixels in a pixel adjacent thereto; the pixel comprises a plurality of sub-pixels;

each data line group comprises three first data lines and three second data lines, the first data lines being configured to load a potential of a positive polarity, and the second data lines being configured to load a potential of a negative polarity; in each candidate connection mode, each data line group satisfies at least one of the following conditions: at least two first data lines in the data line group are connected; and at least two second data lines in the data line group are connected;

wherein the apparatus is configured to:

determine a sum of total variation amounts corresponding to the plurality of data line groups in each candidate connection mode as the grayscale variation degree of the $j^{th}$ row of sub-pixels in each candidate connection mode; wherein the total variation amount corresponding to each data line group is an absolute value of a sum of grayscale variation amounts of the respective sub-pixels connected to the data line group; and the grayscale variation amount of each sub-pixel is intended to characterize a variation amount of the reference grayscale of the sub-pixel relative to the grayscale to be displayed;

determine a difference value between the reference grayscale of each sub-pixel in each candidate connection mode and the grayscale to be displayed;

determine that the grayscale variation amount of each sub-pixel in each of the candidate connection modes is zero if each sub-pixel satisfies a first condition; and determine the grayscale variation amount of each sub-pixel in each candidate connection mode as the difference value if each sub-pixel does not satisfy the first condition;

wherein the first condition comprises that the data line connected to each sub-pixel in each candidate connection mode is not connected to another data line, and an absolute value of the difference value is less than or equal to a grayscale threshold;

scan the gate line connected to the $i^{th}$ row of sub-pixels according to a test image, and driving the $i^{th}$ row of sub-pixels through the plurality of data lines;

scan the gate line connected to the $j^{th}$ row of sub-pixels according to the test image;

scan the gate line connected to the $i^{th}$ row of sub-pixels according to a target image, drive the $i^{th}$ row of sub-pixels through the plurality of data lines, and then connect the plurality of data lines according to the target connection mode, the target image being different from the test image; and scan the gate line connected to the $j^{th}$ row of sub-pixels according to the target image, and drive the $j^{th}$ row of sub-pixels through the plurality of data lines.

14. An apparatus for use in driving a display panel, comprising a processor and a memory; wherein the processor is configured to run a program stored in the memory to perform a method for driving the display panel, and the method comprises:

scanning a gate line connected to an $i^{th}$ row of sub-pixels, and driving the $i^{th}$ row of sub-pixels through a plurality of data lines of the display panel, where $i \geq 1$;

scanning a gate line connected to a $j^{th}$ row of sub-pixels, and determining a reference grayscale of each of the $j^{th}$ row of sub-pixels in each candidate connection mode, wherein the plurality of data lines have a plurality of candidate connection modes, and the $i^{th}$ row of sub-pixels and the $j^{th}$ row of sub-pixels are two rows of sub-pixels which are sequentially driven in the display panel, where $j \geq 1$;

determining a target connection mode that minimizes a grayscale variation degree of the $j^{th}$ row of sub-pixels from the plurality of candidate connection modes, wherein the grayscale variation degree is intended to characterize a total variation degree of the reference grayscale of each of the $j^{th}$ row of sub-pixels relative to a grayscale to be displayed;

connecting the plurality of data lines according to the target connection mode;

disconnecting the plurality of data lines; and driving the $j^{th}$ row of sub-pixels through the plurality of data lines, wherein the plurality of data lines comprise a plurality of data line groups arranged in sequence, each data line group comprising at least two data lines; and in each candidate connection mode, any two connected data lines belong to the same data line group; and prior to determining the target connection mode that minimizes the grayscale variation degree of the $j^{th}$ row of sub-pixels, the method further comprises:

determining a sum of total variation amounts corresponding to the plurality of data line groups in each candidate connection mode as the grayscale variation degree of the $j^{th}$ row of sub-pixels in each candidate connection mode, and wherein the total variation amount corresponding to each data line group is an absolute value of a sum of grayscale variation amounts of the respective sub-pixels connected to the data line group; and the grayscale variation amount of each sub-pixel is intended to characterize a variation amount of the reference grayscale of the sub-pixel relative to the grayscale to be displayed.

15. The apparatus according to claim 14, wherein the plurality of data lines comprise a plurality of data line groups arranged in sequence, each data line group comprising at least two data lines; and in each candidate connection mode, any two connected data lines belong to the same data line group; wherein the $j^{th}$ row of sub-pixels are the first row of sub-pixels which are driven after the $i^{th}$ row of sub-pixels are driven; in each candidate connection mode, the data lines in the respective data line groups are connected in the same fashion, and each data line group is connected to sub-pixels in a pixel adjacent thereto; the pixel comprises a plurality of sub-pixels;

each data line group comprises three first data lines and three second data lines, the first data lines being configured to load a potential of a positive polarity, and the second data lines being configured to load a potential of a negative polarity; in each candidate connection mode, each data line group satisfies at least one of the following conditions: at least two first data lines in the data line group are connected; and at least two second data lines in the data line group are connected;

wherein the processor is configured to run the program stored in the memory to perform operations of:

prior to determining the target connection mode that minimizes the grayscale variation degree of the $j^{th}$ row of sub-pixels, determining a sum of total variation amounts corresponding to the plurality of data line groups in each candidate connection mode as the grayscale variation degree of the $j^{th}$ row of sub-pixels in each candidate connection mode; wherein the total variation amount corresponding to each data line group is an absolute value of a sum of grayscale variation amounts of the respective sub-pixels connected to the data line group; and the grayscale variation amount of each sub-pixel is intended to characterize a variation amount of the reference grayscale of the sub-pixel relative to the grayscale to be displayed;

wherein upon determining the reference grayscale of each of the $j^{th}$ row of sub-pixels in each candidate connection mode, determining a difference value between the reference grayscale of each sub-pixel in each candidate connection mode and the grayscale to be displayed;

determining that the grayscale variation amount of each sub-pixel in each of the candidate connection modes is zero if each sub-pixel satisfies a first condition; and determining the grayscale variation amount of each sub-pixel in each candidate connection mode as the difference value if each sub-pixel does not satisfy the first condition;

wherein the first condition comprises that the data line connected to each sub-pixel in each candidate connection mode is not connected to another data line, and an absolute value of the difference value is less than or equal to a grayscale threshold;

scanning the gate line connected to the $i^{th}$ row of sub-pixels and driving the $i^{th}$ row of sub-pixels through the plurality of data lines comprises:

scanning the gate line connected to the $i^{th}$ row of sub-pixels according to a test image, and driving the $i^{th}$ row of sub-pixels through the plurality of data lines;

scanning the gate line connected to the $j^{th}$ row of sub-pixels comprises:

scanning the gate line connected to the $j^{th}$ row of sub-pixels according to the test image;

connecting the plurality of data lines according to the target connection mode comprises:

scanning the gate line connected to the $i^{th}$ row of sub-pixels according to a target image, driving the $i^{th}$ row of sub-pixels through the plurality of data lines, and then connecting the plurality of data lines according to the target connection mode, the target image being different from the test image; and driving the $j^{th}$ row of sub-pixels through the plurality of data lines comprises:

scanning the gate line connected to the $j^{th}$ row of sub-pixels according to the target image, and driving the $j^{th}$ row of sub-pixels through the plurality of data lines.

16. A computer-readable storage medium, the computer-readable storage memory being configured to store a computer program therein, which, when being run by a processor, enables the processor to perform a method for driving the display panel, and the method comprises:

scanning a gate line connected to an $i^{th}$ row of sub-pixels, and driving the $i^{th}$ row of sub-pixels through a plurality of data lines of the display panel, where $i \geq 1$;

scanning a gate line connected to a $j^{th}$ row of sub-pixels, and determining a reference grayscale of each of the $j^{th}$ row of sub-pixels in each candidate connection mode, wherein the plurality of data lines have a plurality of candidate connection modes, and the $i^{th}$ row of sub-pixels and the $j^{th}$ row of sub-pixels are two rows of sub-pixels which are sequentially driven in the display panel, where $j \geq 1$;

determining a target connection mode that minimizes a grayscale variation degree of the $j^{th}$ row of sub-pixels from the plurality of candidate connection modes, wherein the grayscale variation degree is intended to characterize a total variation degree of the reference grayscale of each of the $j^{th}$ row of sub-pixels relative to a grayscale to be displayed;

connecting the plurality of data lines according to the target connection mode;

disconnecting the plurality of data lines; and driving the $j^{th}$ row of sub-pixels through the plurality of data lines, wherein the plurality of data lines comprise a plurality of data line groups arranged in sequence, each data line group comprising at least two data lines; and in each candidate connection mode, any two connected data lines belong to the same data line group; and prior to determining the target connection mode that minimizes the grayscale variation degree of the $j^{th}$ row of sub-pixels, the method further comprises:

determining a sum of total variation amounts corresponding to the plurality of data line groups in each candidate connection mode as the grayscale variation degree of the $j^{th}$ row of sub-pixels in each candidate connection mode, and wherein the total variation amount corresponding to each data line group is an absolute value of a sum of grayscale variation amounts of the respective sub-pixels connected to the data line group; and the grayscale variation amount of each sub-pixel is intended to characterize a variation amount of the reference grayscale of the sub-pixel relative to the grayscale to be displayed.

17. The computer-readable storage medium according to claim 16, wherein the plurality of data lines comprise a plurality of data line groups arranged in sequence, each data line group comprising at least two data lines; and in each candidate connection mode, any two connected data lines belong to the same data line group; wherein the $j^{th}$ row of sub-pixels are the first row of sub-pixels which are driven after the $i^{th}$ row of sub-pixels are driven; in each candidate connection mode, the data lines in the respective data line groups are connected in the same fashion, and each data line group is connected to sub-pixels in a pixel adjacent thereto; the pixel comprises a plurality of sub-pixels;

each data line group comprises three first data lines and three second data lines, the first data lines being configured to load a potential of a positive polarity, and the second data lines being configured to load a potential of a negative polarity; in each candidate connection mode, each data line group satisfies at least one of the following conditions: at least two first data lines in the data line group are connected; and at least two second data lines in the data line group are connected;

wherein the computer program, when being run by the processor, enables the processor to perform operations of:

prior to determining the target connection mode that minimizes the grayscale variation degree of the $j^{th}$ row of sub-pixels, determining a sum of total variation amounts corresponding to the plurality of data line groups in each candidate connection mode as the grayscale variation degree of the $j^{th}$ row of sub-pixels in each candidate connection mode; wherein the total variation amount corresponding to each data line group is an absolute value of a sum of grayscale variation amounts of the respective sub-pixels connected to the data line group; and the grayscale variation amount of each sub-pixel is intended to characterize a variation amount of the reference grayscale of the sub-pixel relative to the grayscale to be displayed;

wherein upon determining the reference grayscale of each of the $j^{th}$ row of sub-pixels in each candidate connection mode, determining a difference value between the reference grayscale of each sub-pixel in each candidate connection mode and the grayscale to be displayed;

determining that the grayscale variation amount of each sub-pixel in each of the candidate connection modes is zero if each sub-pixel satisfies a first condition; and determining the grayscale variation amount of each sub-pixel in each candidate connection mode as the difference value if each sub-pixel does not satisfy the first condition;

wherein the first condition comprises that the data line connected to each sub-pixel in each candidate connection mode is not connected to another data line, and an absolute value of the difference value is less than or equal to a grayscale threshold;

scanning the gate line connected to the $i^{th}$ row of sub-pixels and driving the $i^{th}$ row of sub-pixels through the plurality of data lines comprises:

scanning the gate line connected to the $i^{th}$ row of sub-pixels according to a test image, and driving the $i^{th}$ row of sub-pixels through the plurality of data lines;

scanning the gate line connected to the $j^{th}$ row of sub-pixels comprises:

scanning the gate line connected to the $j^{th}$ row of sub-pixels according to the test image;

connecting the plurality of data lines according to the target connection mode comprises:

scanning the gate line connected to the $i^{th}$ row of sub-pixels according to a target image, driving the $i^{th}$ row of sub-pixels through the plurality of data lines, and then connecting the plurality of data lines according to the target connection mode, the target image being different from the test image; and driving the $j^{th}$ row of sub-pixels through the plurality of data lines comprises:

scanning the gate line connected to the $j^{th}$ row of sub-pixels according to the target image, and driving the $j^{th}$ row of sub-pixels through the plurality of data lines.

* * * * *